US005842693A

United States Patent [19]

Stevens et al.

[11] Patent Number: 5,842,693

[45] **Date of Patent: *Dec. 1, 1998**

[54] AUTOMATED MAIL EXTRACTION AND REMITTANCE PROCESSING

[75] Inventors: Albert F. Stevens, Moorestown; Mark A. Stevens, Medford; Robert R. Dewitt, Moorestown; William R. Lile, Medford; Michael E. York, Sicklerville, all of N.J.; Jeffrey L. Chodack, Newark, Del.; Roy E. Patterson, Tabernacle, N.J.

[73] Assignee: Opex Corporation, Moorestown, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 969,188

[22] Filed: Nov. 13, 1997

Related U.S. Application Data

[63] Continuation of Ser. No. 552,302, Nov. 2, 1995, abandoned, which is a continuation of Ser. No. 351,638, Dec. 7, 1994, Pat. No. 5,464,099, which is a continuation of Ser. No. 234,532, Apr. 28, 1994, Pat. No. 5,518,121, which is a division of Ser. No. 887,621, May 22, 1992, Pat. No. 5,310,062, which is a continuation-in-part of Ser. No. 363,511, Jun. 8, 1989, Pat. No. 5,115,918, which is a division of Ser. No. 904,966, Sep. 5, 1986, Pat. No. 4,863,037.

[51] Int. Cl.[6] ..... B65H 5/22

[52] U.S. Cl. ..... 271/4.01; 271/10.01; 209/702; 209/942

[58] Field of Search ..... 271/10.01, 10.09, 271/10.11, 4.01, 4.08, 3.14; 209/534, 900, 942, 702, 705

[56] References Cited

U.S. PATENT DOCUMENTS

| | | |
|---|---|---|
| 771,852 | 10/1904 | Wolf et al. . |
| 2,806,614 | 9/1957 | Butz . |
| 2,894,626 | 7/1959 | Mulders et al. . |
| 2,994,428 | 8/1961 | Daubendick . |
| 3,116,718 | 1/1964 | Krupotich et al. . |

(List continued on next page.)

FOREIGN PATENT DOCUMENTS

| | | |
|---|---|---|
| 0048485 | 3/1982 | European Pat. Off. . |
| 0169145 | 1/1986 | European Pat. Off. . |
| 2382951 | 10/1978 | France . |
| 2428529 | 1/1980 | France . |
| 2568232 | 1/1986 | France . |

(List continued on next page.)

OTHER PUBLICATIONS

Pitney Bowes, Model 1290 Opener/Extractor Brochure, 1988.

*Primary Examiner*—David H. Bollinger
*Attorney, Agent, or Firm*—Dann, Dorfman, Herrell and Skillman, P.C.

[57] ABSTRACT

In a method for the automated processing of bulk mail, envelopes are transferred to a receiving apparatus in bulk fashion (from incoming mail trays or the like) for the extraction of documents contained by the envelopes, and the extracted documents are delivered to a remittance processing device, preferably both automatically and without the need for human intervention. Subsequent processing of the extracted documents within the remittance processing device then proceeds in usual fashion, completing the acquisition of information which is necessary to ready such documents for deposit into the banking system. Also disclosed are various presorting functions so that only envelopes containing documents of a specified type will be fully processed, other sorting functions such as the identification of specific types of documents (invoices or checks) for separate processing, and the use of a single extraction device to deliver extracted documents to either one, or a series of remittance processing devices. If desired, a buffer is provided which can receive and temporarily store documents received from the extraction device, for appropriate delivery to the remittance processing device responsive to demand.

2 Claims, 16 Drawing Sheets

U.S. PATENT DOCUMENTS

| | | | |
|---|---|---|---|
| 3,143,100 | 8/1964 | Krupotich . | |
| 3,146,902 | 9/1964 | Voelker . | |
| 3,149,720 | 9/1964 | Woolfolk . | |
| 3,238,926 | 3/1966 | Huck . | |
| 3,266,626 | 8/1966 | Simjian et al. . | |
| 3,311,369 | 3/1967 | Pitt . | |
| 3,315,805 | 4/1967 | Brenner et al. . | |
| 3,363,756 | 1/1968 | Dykaar et al. | 271/10.09 X |
| 3,363,783 | 1/1968 | Rehm et al. . | |
| 3,381,564 | 5/1968 | Whiteford . | |
| 3,384,252 | 5/1968 | West . | |
| 3,386,574 | 6/1968 | Kaplan . | |
| 3,509,535 | 4/1970 | Berube . | |
| 3,523,687 | 8/1970 | Petersen et al. . | |
| 3,726,454 | 4/1973 | Robbins . | |
| 3,808,926 | 5/1974 | Osland . | |
| 3,884,010 | 5/1975 | Bardo . | |
| 3,895,220 | 7/1975 | Nelson et al. . | |
| 3,933,350 | 1/1976 | Mignano | 271/10.09 |
| 3,952,874 | 4/1976 | Owen | 209/900 X |
| 3,966,047 | 6/1976 | Steiner . | |
| 4,016,708 | 4/1977 | DeHart . | |
| 4,078,789 | 3/1978 | Kittredge et al. . | |
| 4,113,105 | 9/1978 | DeHart et al. . | |
| 4,119,194 | 10/1978 | Freeman et al. . | |
| 4,121,716 | 10/1978 | Luperti et al. . | |
| 4,124,169 | 11/1978 | Hatanaka . | |
| 4,139,977 | 2/1979 | Russell . | |
| 4,142,430 | 3/1979 | Long et al. . | |
| 4,155,842 | 5/1979 | Wallace et al. . | |
| 4,236,639 | 12/1980 | Boettge et al. . | |
| 4,255,652 | 3/1981 | Weber . | |
| 4,262,895 | 4/1981 | Wenthe, Jr. . | |
| 4,272,180 | 6/1981 | Satomi et al. . | |
| 4,295,321 | 10/1981 | DeHart et al. . | |
| 4,299,325 | 11/1981 | Quinton et al. . | |
| 4,349,111 | 9/1982 | Shah et al. . | |
| 4,353,197 | 10/1982 | Stevens et al. . | |
| 4,360,108 | 11/1982 | Logothetis . | |
| 4,373,848 | 2/1983 | Bishop . | |
| 4,376,287 | 3/1983 | Sechi . | |
| 4,443,006 | 4/1984 | Hasegawa | 271/10.11 |
| 4,566,595 | 1/1986 | Fustier . | |
| 4,576,287 | 3/1986 | Bingham et al. . | |
| 4,578,759 | 3/1986 | Horii | 209/900 X |
| 4,584,529 | 4/1986 | Aoyama . | |
| 4,615,518 | 10/1986 | Di Blasio | 271/10.11 X |
| 4,625,497 | 12/1986 | Owen . | |
| 4,687,106 | 8/1987 | Prins . | |
| 4,690,268 | 9/1987 | Ueshin . | |
| 4,694,963 | 9/1987 | Takesako . | |
| 4,697,071 | 9/1987 | Hiraoka et al. . | |
| 4,722,444 | 2/1988 | Murphy et al. . | |
| 4,734,643 | 3/1988 | Bubenik et al. . | |
| 4,747,492 | 5/1988 | Saito et al. . | |
| 4,747,817 | 5/1988 | Newsome . | |
| 4,749,087 | 6/1988 | Buttifant . | |
| 4,760,923 | 8/1988 | Lundblad et al. . | |
| 4,809,340 | 2/1989 | Mersereau . | |
| 4,863,037 | 9/1989 | Stevens et al. | 209/3.1 X |
| 4,893,454 | 1/1990 | Russell . | |
| 4,913,295 | 4/1990 | Murphy et al. . | |
| 4,921,388 | 5/1990 | Nelson . | |
| 4,924,088 | 5/1990 | Carman et al. . | |
| 4,944,505 | 7/1990 | Sherman . | |
| 4,968,419 | 11/1990 | Karlus et al. . | |
| 4,979,605 | 12/1990 | Svyatsky . | |
| 4,993,700 | 2/1991 | Winkler . | |
| 5,036,168 | 7/1991 | Kikuchi et al. . | |
| 5,036,190 | 7/1991 | Lile et al. . | |
| 5,036,984 | 8/1991 | Labarthe . | |
| 5,052,168 | 10/1991 | DeWitt et al. . | |
| 5,061,146 | 10/1991 | Nelson . | |
| 5,096,360 | 3/1992 | Nelson . | |
| 5,115,918 | 5/1992 | DeWitt et al. | 209/3.1 |
| 5,119,954 | 6/1992 | Svyatsky et al. . | |
| 5,134,834 | 8/1992 | Hayduchok . | |
| 5,154,405 | 10/1992 | Graveson et al. . | |
| 5,156,515 | 10/1992 | Charron et al. . | |
| 5,224,697 | 7/1993 | Darchis et al. . | |
| 5,310,062 | 5/1994 | Stevens et al. | 209/900 X |
| 5,439,118 | 8/1995 | York | 209/900 X |
| 5,441,159 | 8/1995 | DeWitt et al. | 209/900 X |
| 5,464,099 | 11/1995 | Stevens et al. | 209/900 X |
| 5,518,121 | 5/1996 | Stevens et al. | 209/900 X |

FOREIGN PATENT DOCUMENTS

| | | | |
|---|---|---|---|
| 54-113161 | 7/1979 | Japan . | |
| 63-202554 | 8/1988 | Japan . | |
| 2106085 | 4/1983 | United Kingdom | 271/10.01 |
| 2121959 | 1/1984 | United Kingdom . | |
| 2174680 | 11/1986 | United Kingdom . | |
| WO 8600852 | 2/1986 | WIPO . | |
| WO 8801543 | 3/1988 | WIPO . | |
| WO 8810226 | 6/1988 | WIPO . | |

AUTOMATED MAIL EXTRACTION AND REMITTANCE PROCESSING

RELATED CASES

This application is a continuation of U.S. application Ser. No. 08/552,302, filed Nov. 2, 1995, now abandoned, which is a continuation of U.S. application Ser. No. 08/351,638, filed Dec. 7, 1994, and which issued as U.S. Pat. No. 5,464,099 on Nov. 7, 1995, which in itself is a continuation of U.S. patent application Ser. No. 08/234,532, filed on Apr. 28, 1994, which issued as U.S. Pat. No. 5,518,121 on May 21, 1996 which is itself a divisional of U.S. patent application Ser. No. 07/887,621, filed May 22, 1992, and since issued as U.S. Pat. No. 5,310,062, dated May 10, 1994, which is itself a continuation-in-part of U.S. patent application Ser. No. 07/363,511, filed Jun. 8, 1989, and since issued as U.S. Pat. No. 5,115,918, dated May 26, 1992, which is itself a divisional of U.S. patent application Ser. No. 06/904,966, filed Sep. 5, 1986, and since issued as U.S. Pat. No. 4,863,037, dated Sep. 5, 1989, which are each incorporated by reference as if fully set forth herein.

BACKGROUND OF THE INVENTION

This invention relates to the automated processing of bulk mail, including extraction of documents from envelopes as well as remittance processing of the extracted documents.

A variety of organizations customarily receive mail in large quantities and in bulk form, and a number of devices have been developed to facilitate the handling of such mail so as to enhance productivity.

One such productivity aid is generally characterized by devices which are used for receiving mail (i.e., envelopes) in bulk form, and for extracting contents (i.e., documents) from such mail for subsequent processing. This may simply include an extraction of documents from envelopes, for subsequent processing making use of other devices, or by hand. However, such extraction may further include sorting procedures for directing only specified types of envelopes to the extraction apparatus and/or orienting procedures for organizing the extracted documents prior to their further processing. An example of a comprehensive apparatus of this general type is the Opex System 100, which is manufactured by Opex Corporation of Moorestown, N.J.

Another productivity aid is generally characterized by devices which are used for receiving documents, generally an invoice for payment and a corresponding check or bank draft, and for facilitating the entry of accounting information needed to ready such documents for deposit into the banking system. Such remittance processing devices generally operate to receive previously extracted documents (invoices and checks), for convenient presentation to an operator so that appropriate accounting information may be obtained and entered prior to stacking and subsequent processing (deposit) of such documents. Examples of remittance processing equipment of this general type are the Model S4000, among others, manufactured by Unisys Corp., of Detroit, Mich., and the Model 9400, among others, manufactured by BancTec (CES), of Dallas, Tex.

The above-described extraction devices and remittance processing devices have worked well in enhancing the productivity of mail room and accounting operations by expediting the processing of invoices, thereby reducing the amount of time which it takes to deposit the accompanying checks into the banking system. However, to date, devices for directly combining such functions in automated fashion have not been commercially available. Rather, common practice is for documents to first be extracted from their envelopes by an extraction device, for stacking in appropriate bins or trays, and for office personnel to then hand carry the extracted documents to the remittance processing device so that other personnel may then operate upon them. Such steps are clearly labor intensive, and are preferably avoided in order to enhance productivity and reduce processing times and the potential for error.

SUMMARY OF THE INVENTION

It is therefore a primary object of the present invention to provide an integrated apparatus for automatically extracting documents from envelopes and for then presenting such documents for remittance processing.

It is also an object of the present invention to provide an apparatus for extracting documents from envelopes and for presenting such extracted documents for remittance processing in automated fashion and in bulk form.

It is also an object of the present invention to provide an apparatus for extracting documents from envelopes and for presenting such extracted documents for remittance processing which requires a minimum amount of intervention by an operator.

It is also an object of the present invention to provide an apparatus for extracting documents from envelopes and for presenting such extracted documents for remittance processing which is sufficiently versatile to handle different envelope configurations, as well as differences in the contents which are to be processed.

It is also an object of the present invention to provide an apparatus for extracting documents from envelopes and for presenting such extracted documents for remittance processing which is compatible with conventional mail room and remittance processing operations, including operations which precede extraction, and operations which follow remittance processing.

It is also an object of the present invention to provide an apparatus for extracting documents from envelopes and for presenting such extracted documents for remittance processing which is straightforward in operation, and relatively simple to service and use.

It is also an object of the present invention to provide an apparatus for extracting documents from envelopes and for presenting such extracted documents for remittance processing which is capable of assuming different configurations to satisfy varying needs of the industry.

These and other objects are achieved in accordance with the present invention by providing an apparatus for the automated processing of bulk mail wherein envelopes are transferred to the apparatus in bulk fashion (from incoming mail trays or the like), for the extraction of documents contained by the envelopes, followed by delivery of the extracted documents to a remittance processing device, both automatically and without the need for human intervention. Subsequent processing of the extracted documents within the remittance processing device then proceeds in usual fashion, completing the acquisition of information which is necessary to ready such documents for deposit into the banking system.

Versatility of the apparatus is enhanced by providing additional functions which can be employed in accordance with the present invention to compliment operations of the basic apparatus.

For example, various presorting functions may be employed so that only envelopes containing documents of a specified type will be fully processed. Since a primary purpose of the present invention is to arrange for the deposit of checks as soon as possible, such presorting will often operate to identify envelopes containing invoices and accompanying checks for payment. Envelopes containing other types of documents, or documents in addition to those which are desired, as well as envelopes which might contain documents which are attached by staples, paper clips or the like and which are therefore not appropriate for automated extraction, will then preferably be set aside for separate processing. Consequently, prior to extraction, various sorting functions may be performed to identify envelopes which do not contain the documents which are desired. Steps may then be taken to remove such envelopes from the processing stream.

Yet other sorting functions may be employed following extraction of the documents. For example, it may be desired to identify specific types of documents (invoices or checks) for separate processing, without subjecting the extracted documents to a remittance processing procedure. Alteratively, it may be desired to process such documents, in bulk, based upon certain common criteria deemed appropriate for effective presentation to the remittance processing device.

Yet another consideration is that in view of the significant number of envelopes which can be processed by existing mail extraction equipment, a single extraction device may be used to deliver extracted documents to either one, or a series of remittance processing devices, as desired. The delivery of documents to a single remittance processing device may, if desired, be accomplished in connection with a buffer which can receive and temporarily store documents received from the extraction device, for appropriate delivery to the remittance processing device responsive to demand. Alternatively, plural remittance processing devices may be fed by a single extraction device by gating documents delivered from the extraction device toward the several remittance processing devices which are in use, either with or without a buffering of the extracted documents prior to such remittance processing.

For further detail regarding preferred embodiment devices produced in accordance with the present invention, reference is made to the detailed description which is provided below, taken in conjunction with the following illustrations.

BRIEF DESCRIPTION OF THE DRAWINGS

In the several views provided, like reference numbers denote similar structure.

DETAILED DESCRIPTION OF PREFERRED EMBODIMENTS

Figure 1:
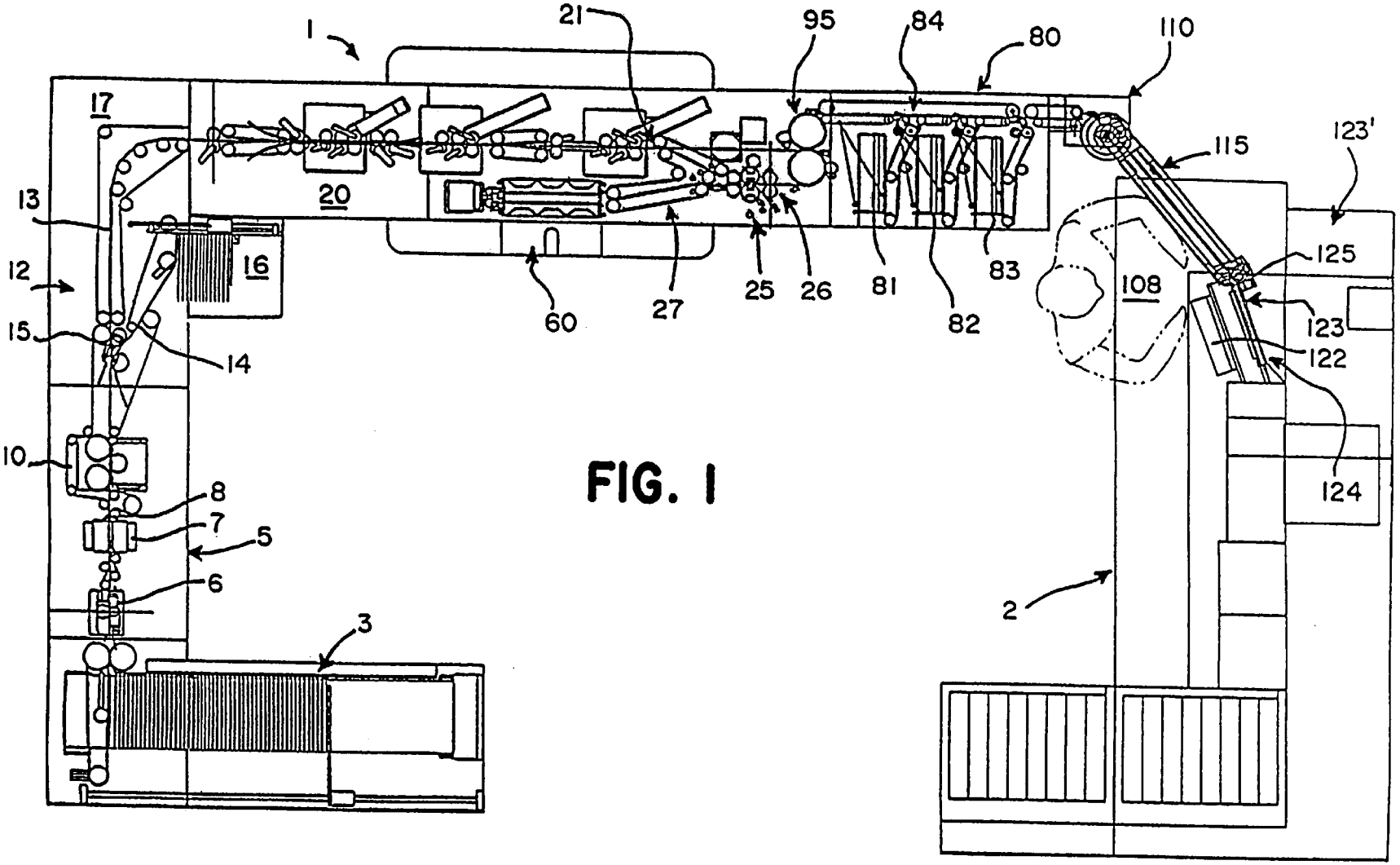
FIG. 1 is a schematic, plan view of a preferred embodiment apparatus produced in accordance with the present invention.
Figure 2:
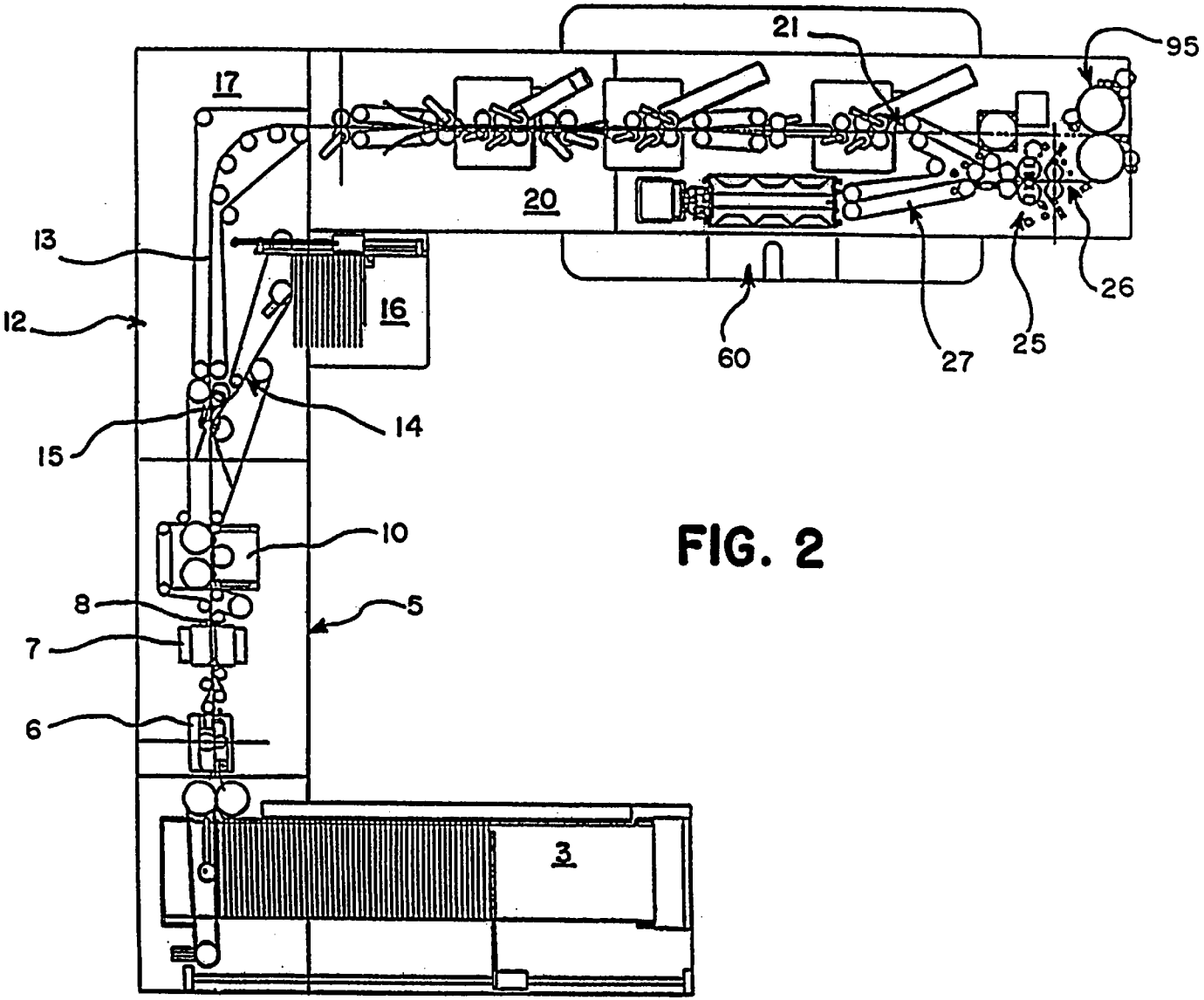
FIG. 2 is an enlarged, plan view of portions of the apparatus of FIG. 1 which accomplish the presorting and extraction functions.
Figure 3:
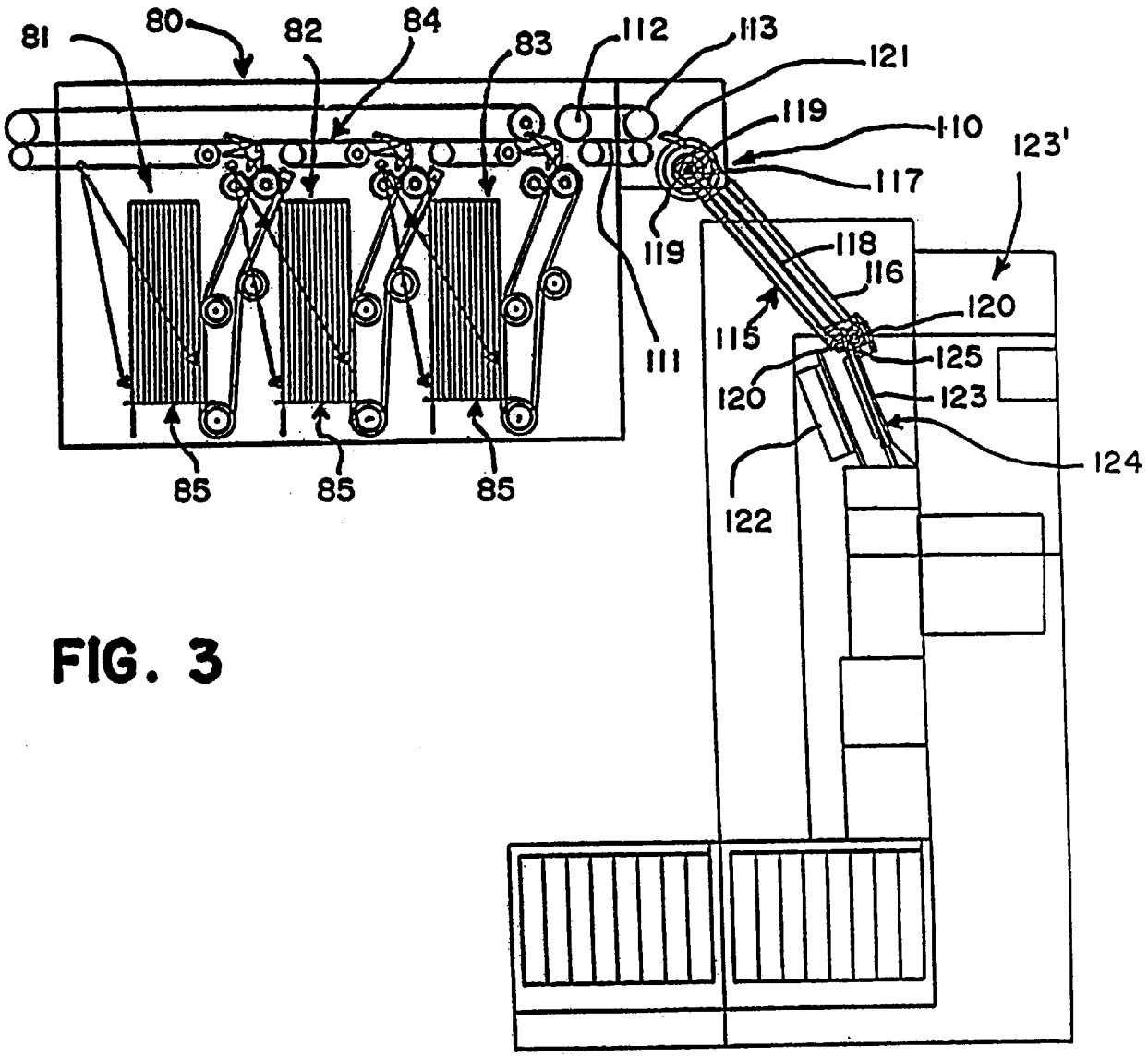
FIG. 3 is an enlarged, plan view of portions of the apparatus of FIG. 1 which accomplish the post-sorting and remittance processing functions.

FIGS. 1 to 3 collectively illustrate an apparatus 1 which is capable of receiving a quantity of envelopes containing unspecified documents, and for subjecting specified envelopes to procedures which will first extract any documents from the envelopes, and thereafter deliver such extracted documents to a remittance processing station 2. For purposes of the discussion which is to follow, the "documents" which are to be processed will be paired documents including an invoice, and a check for its payment. However, other types of documents, and single documents as well as plural grouped documents, may similarly be processed by the extraction apparatus 1 if desired. The remittance processing station 2, in and of itself, can be any of a number of available devices for accomplishing such a function, examples being the previously-mentioned Unisys Model S4000 and Banc-Tec Model 9400, among others. Such remittance processing equipment may employ any of the conventional modes of operation which are offered, including those employing "direct feed" systems as well as those employing a "drop slot" for receiving documents for processing. As will be discussed more fully below, the apparatus 1 can accommodate either of these two available configurations. Since remittance processing equipment of this general type is known, further detail regarding such equipment is omitted except where needed for an explanation of the manner in which the apparatus 1 cooperates with the remittance processing station 2.

The apparatus 1 of the present invention is comprised of a series of processing stations which can either be assembled from discrete modules, or assembled as an integral unit, as desired.

Initially, a feed station 3 is provided for receiving a quantity of envelopes containing documents, for subsequent processing. If desired, the envelopes may be opened (severed) along one or more of their edges by slitting desired edges prior to introduction of the envelopes into the feed station 3. However, it is generally preferred to introduce envelopes into the feed station 3 which have not yet been opened, since the apparatus 1 can incorporate means for doing so, and since this avoids the need for a separate, pre-processing step. In any event, the feed station 3 operates to receive the quantity of envelopes which are to be processed, and to serially deliver the envelopes from the feed station 3, one at a time, for introduction into those portions of the apparatus 1 which follow. Further detail regarding means for implementing the feed station 3 may be had with reference to U.S. Pat. No. 4,863,037, and the input station which it describes.

In the embodiment which is illustrated in FIGS. 1 to 3, the serially fed envelopes are then introduced into a detection station 5 which operates to identify specified characteristics associated with the envelopes which are being processed in order to identify those envelopes which contain desired documents for continued processing in accordance with the present invention. Preferably, such processing will involve the extraction and remittance processing of invoices and checks for their payment, for prompt deposit. It is therefore generally preferable to identify envelopes containing paired documents of this type, and envelopes which do not.

To this end, the envelopes may be introduced into a device 6 for measuring the thickness of the envelopes, with their contents, to identify envelopes containing more than two documents, plastic clips, returned credit or debit cards, or documents which have been folded over, and which are therefore not to be subjected to automated processing in accordance with the present invention. The envelopes may also be introduced into a device 7 for detecting any metal objects which might be contained by the envelopes, such as staples and paper clips, and which are therefore also not to be subjected to automated processing in accordance with the present invention. To be noted is that although the thickness measure device 6 is shown preceding the metal detecting device 7, this order is not essential and may be reversed if desired. Also associated with the thickness measuring device 6 and the metal detecting device 7 is a device 8 for measuring the lengths of the envelopes, for establishing timing within the apparatus 1 as subsequent operations proceed, or if desired, for detecting envelopes of an improper length for further processing. Further detail regarding means for implementing the thickness measuring device 6 and the metal detecting device 7 is again disclosed in U.S. Pat. No. 4,863,037, with reference to the scanning station which is described. The length measuring device 8 is readily implemented making use of a photocell or similar component for detecting leading and trailing envelope edges, and accordingly, for measuring length based upon the transport speed established for the envelopes.

The detection station 5 additionally incorporates a device 10 for determining the type and orientation of certain documents which might be contained within the envelopes, and which incorporate magnetic ink markings for detection purposes (e.g., a check or a specially marked invoice). To be noted is that such detection can be accomplished even though the magnetically marked documents are still contained within the enclosure of an envelope, making use of techniques which are disclosed in U.S. patent application Ser. No. 07/687,982, filed Apr. 19, 1991, the subject matter of which is incorporated by reference as if fully set forth herein. Making use of such techniques, the device 10 may be used to identify the orientation of such documents relative to the envelopes which contain them including those which face forward and those which face rearward, as well as those which are upright and those which are inverted. Further detail regarding means for implementing the orientation determining device 10 is again disclosed in U.S. Pat. No. 4,863,037, with reference to the detection station which is described. It is important to note that as with the thickness measuring device 6 and the metal detecting device 7, the orientation determining device 10 need not follow the devices 6, 7, but may also precede such devices, or may be positioned between them, as desired. It is also possible to place the orientation determining device 10 at other locations within the apparatus 1, depending upon available space and the desired functions to be accomplished (e.g., after the extraction procedure which is to follow, to inspect the extracted documents prior to their continued processing).

Irrespective of their order, the thickness measuring device 6, the metal detecting device 7 and the orientation determining device 10 may be followed by a sorting station 12 which operates responsive to the detection devices 6, 7, 10 to separate envelopes which are to be further processed (path 13) from envelopes which are not to be processed (path 14) due their nonconforming nature. Nonconforming envelopes may be diverted from further processing responsive to a bi-directional gate 15 which is capable of directing appropriate envelopes on for further processing, and for diverting nonconforming envelopes to a stacker 16 for receiving and collecting envelopes which are not to be processed making use of the apparatus 1. Once again, both the sorting device 12 and the stacker 16 may be implemented by devices which are disclosed in U.S. Pat. No. 4,863,037, with reference to the sorting station which is described.

To be noted is that in some cases, such as when the number of nonconforming envelopes is expected to be rather low (e.g., resulting from a separate presorting operation), and where the processing of such nonconforming documents would not significantly compromise productivity, it may be preferable to further process all envelopes exiting the detection station 5, and the sorting station 12 may be omitted (or deactivated) in such cases. Alternatively, sorting may be accomplished responsive to only some of the detection devices 6, 7, 10. For example, the thickness measuring device 6 and the metal detecting device 7 may be employed to remove (presort) envelopes which do not contain only a pair of documents from further processing, while passing envelopes which contain only a pair of documents on for further processing irrespective of the orientation of such documents relative to the envelope which contains them.

In any event, as a consequence of the foregoing procedures, envelopes traversing the path 13 will generally constitute only those envelopes which enclose an invoice and a check for payment which are free (unattached) and ready for extraction from the envelopes which contain them. Such envelopes then traverse a corner section (turn-around) 17, for introduction into a cutting station 20. The corner section 17 is provided, as shown, primarily as a convenience in order to establish an overall configuration (or floor plan) for the apparatus 1 which is compact and easily serviced by a minimum number of personnel. Alternatively, the corner section 17 could be omitted from the apparatus, resulting in an in-line configuration. However, this is presently considered to be somewhat less than desirable in view of the floor space which would then be required to accommodate such an apparatus. To be noted is that other configurations and floor plans are readily achievable by providing a corner section 17 at other locations, and between other stations, as desired for a particular configuration.

The cutting station 20 is preferably configured to open (sever) a plurality of envelope edges for each of the envelopes which are to be processed through the apparatus 1. This may be freely varied, as desired. However, it is generally preferred to sever three contiguous envelope edges since this is most compatible with the extraction procedure which is to follow. Means for implementing the cutting station 20 are again disclosed in U.S. Pat. No. 4,863,037, with reference to the edge-severing station which is described. Resulting from this, and as is presently preferred, three of four envelope edges will be severed including a leading, lateral edge and both longitudinal edges of each envelope, readying the envelope and its contents for the extraction procedure which is to follow.

The extraction station 25 then operates to receive edge-severed envelopes from the cutting station 20 and to remove the envelope faces which surround the contained documents. The removed envelope faces are then diverted for disposal, leaving extracted and paired documents comprised of an invoice and a check for delivery from the extraction station 25, at 26. To be noted is that in certain cases, operations of the extraction station 25 will not result in an effective removal of the contents from a particular envelope (e.g., contents remaining merged with envelope faces, folded contents, etc.) making such documents inappropriate for further processing by the apparatus 1. Such documents, and the remnants of the envelope which surrounded them, are preferably diverted from the discharge point 26 toward a mechanism 27 which operates to reunite the documents with their envelope (envelope faces), preferably in their original order, for separate processing as desired.

Figure 4:
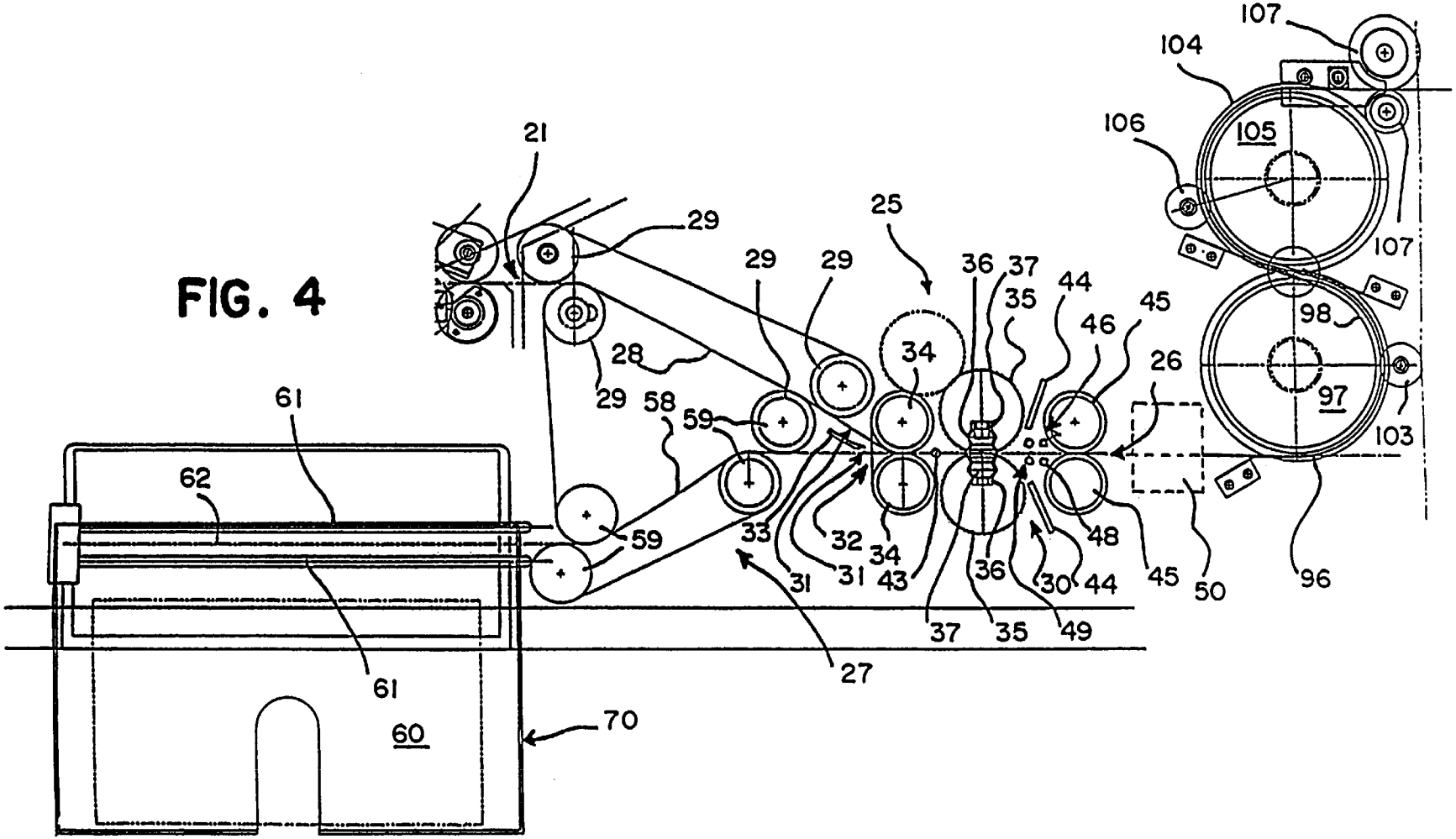
FIG. 4 is an enlarged, schematic plan view of portions of the apparatus of FIG. 1 which accomplish the extraction function.

Means for implementing the extraction station 25, as well as for implementing the reuniting mechanism 27, are again disclosed in U.S. Pat. No. 4,863,037, with reference to the extraction station which is described. However, other devices may also be employed for accomplishing these functions. One such alternative embodiment extraction device 30 is illustrated in FIG. 4.

The extraction device 30 receives envelopes from the cutting station 20, at 21, which are introduced into the extraction device 30 along a transport path 31. As previously indicated, these envelopes will each be severed along three contiguous edges including a leading transverse edge and both longitudinal edges of each envelope. Initially, the edge-severed envelopes are caused to progress along an angled portion of the transport path 31, between a pair of opposing belts 28 disposed about a series of rollers 29. Thereafter, the edge-severed envelopes are caused to pass a turn at 32 (which assists in subsequent operations as will be discussed more fully below), preferably with the assistance of a guide 33, for introduction between a pair of driven rollers 34. As will be discussed more fully below, the rollers 34 are capable of rotation in either direction in order to transport envelopes and their contents in either of two directions along the transport path 31.

Envelopes (with contents) traversing the transport path 31 are accordingly received between the driven rollers 34, and are passed from the rollers 34 toward an opposing pair of suctioning rollers 35. The suctioning rollers 35 are also driven rollers capable of operation in either direction. However, unlike the rollers 34, the rollers 35 are not placed in contact with one another, but rather are spaced from one another by a small distance. Each of the rollers 35 include a cavity 36 for receiving a suction cup 37 which is selectively collapsible upon entraining a paper surface (e.g., an envelope face) as an opened envelope is passed between the suctioning rollers 35.

The suction cups 37 are of the type which is disclosed in U.S. Pat. No. 5,052,168, dated Oct. 1, 1991, the subject matter of which is incorporated by reference as if fully set forth herein. Such suction cups operate to draw faces of the envelope to the suction cups 37 as the envelope faces pass between the suctioning rollers 35, without requiring initial contact between the suction cups 37 and the envelope faces which they are to engage. Once drawn to the suction cups 37, the suction cups 37 operate to securely engage the envelope faces, retaining them to the suctioning rollers 35 without also entraining the envelope's contents. This operates to promote engagement between the faces of an envelope and the suctioning rollers 35 while minimizing the potential for entraining documents which are contained by the envelope.

Figure 5A:
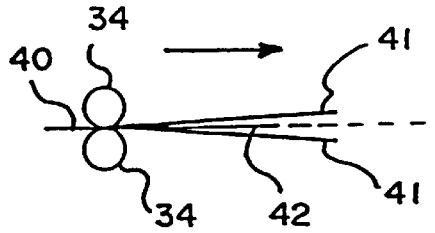
FIGS. 5*a*, 5*b*, 5*c* and 5*d* are sequential schematic views illustrating an extraction of documents from an envelope employing the apparatus of FIG. 4.
Figure 5B:
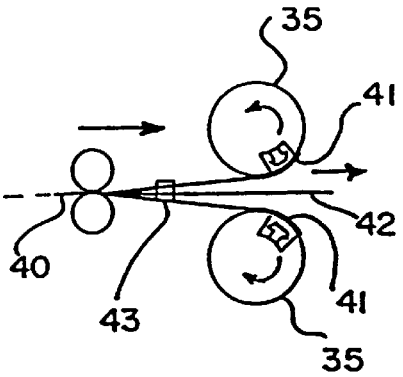

As a consequence of this, and with reference to FIGS. 5*a* and 5*b*, as an envelope 40 leaves the rollers 34, the severed envelope faces 41 are permitted to diverge (slightly) from the entrained contents 42, as shown in FIG. 5*a*. An air jet 43 may be placed in alignment with the diverging envelope faces 41 and the contents 42, to assist in their separation from one another. As the envelope 40 passes between the suctioning rollers 35, the faces 41 of the envelope 40 are drawn outwardly toward the suction cups 37, so that the faces 41 separate from the contents 42 and become entrained by the suctioning rollers 35 without also entraining the contents 42 which are then disposed between the envelope faces 41.

Referring next to FIG. 5*b*, continued advancement of the envelope 40 through the rollers 34 is combined with rotation of the suctioning rollers 35 to in essence "peel away" the faces 41 of the envelope 40 from the contents 42 which are then disposed between them. In so doing, the envelope faces 41 may either be fully entrained along the periphery of the suctioning rollers 35, or may be only partially entrained by the suctioning rollers 35, with released portions being entrained by a pair of guides 44 positioned adjacent to the suctioning rollers 35. In any event, as the envelope faces 41 progress around the periphery of the suctioning rollers 35 (retained in place by the suction cups 37), the contents 42 are caused to continue along the transport path 31 toward a pair of driven rollers 45 positioned just beyond the suctioning rollers 35. The rollers 45, which are also capable of rotation in either direction, then operate to withdraw the contents 42 from their associated envelope 40, accomplishing the desired extraction procedure.

In conjunction with such extraction, means are preferably provided either immediately before or immediately after the rollers 45 to verify that all contents have been withdrawn from the associated envelope. One example of a device which may be used to accomplish this function is the photocell detection unit 46 which is shown in FIG. 4. In this configuration, the photocell detection unit 46 is positioned between the suctioning rollers 35 and the driven rollers 45 which follow them, and generally comprises a photocell 47 and a light source 48 disposed on opposite sides of the transport path 31. As a result, light emitted from the source 48 is caused to pass through any documents 42 traversing the transport path 31, for detection by the photocell 47. Changes in light level are then interpreted to confirm not only the extraction of documents from the envelope, but also the number of documents which have been extracted. Means for implementing this function are disclosed in U.S. Pat. No. 5,036,190, dated Jul. 30, 1991, the subject matter of which is incorporated by reference as if fully set forth herein. As an alternative means for accomplishing this function, a pair of vacuum ports 49 may similarly be positioned on opposite sides of the transport path 31 in order to detect documents 42 passing from between the suctioning rollers 35. As the documents 42 are entrained by the vacuum ports 49, a sharp decrease in pressure can be detected, which can in turn be employed to confirm that a pair of documents 42 have been extracted from their associated envelope 40.

If it is determined that two (and only two) documents are then traversing the transport path 31, an effective extraction of documents is declared, and it is assumed that the suctioning rollers 35 entrain only the faces of the envelope which had surrounded the extracted documents (and which are therefore ready for discarding). In so doing, it may also be necessary to similarly analyze the envelope faces 41 which have been separated from the contents 42 to verify that each suctioning roller 35 has engaged an envelope face. Otherwise, it becomes possible to detect two documents issuing from between the suctioning rollers 35, one of which is actually a face of the envelope (the remaining envelope face would then entrain the remaining document), representing an ineffective extraction procedure.

If it is determined that other than two documents are then traversing the transport path 31, an ineffective extraction of documents is declared, and as a result, further processing of the envelope 40 then being operated upon should not take place until the contents 42 of that envelope are inspected to determine their non-conforming nature. For example, if no documents are detected, or if only one document is detected, it is assumed that documents remain entrained by the envelope faces which are then engaged by the suctioning rollers 35, and that the extraction procedure has therefore been ineffective. If more than two documents are detected by the photocell detection unit 116, or if it is determined that one of the suctioning rollers 35 does not entrain an envelope face, it is assumed that an envelope face remains associated with the documents, and that the extraction procedure has been ineffective, or that the thickness measuring device 6 (if used) has in some way missed a document, and that the envelope 40 should have been removed from the processing stream prior to edge-severing and extraction.

Figure 6B:
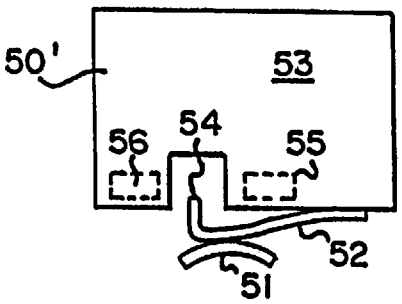
FIG. 6*b* is a top plan view of the thickness measuring device of FIG. 6*a*.

Similar determinations may be made by employing a thickness measuring device 50 which, as shown in FIG. 4 in phantom, follows the rollers 45. This can be implemented making use of an apparatus similar to the thickness measuring device 6 of the detection station 5, in order to measure the thickness of documents issuing from between the rollers 45 and thereby determine the number of documents which are then traversing the transport path 31. However, this can also be implemented by the alternative embodiment thickness measuring device 50' shown in FIGS. 6*a* and 6*b*.

The thickness measuring device 50' includes a stationary plate 51 (which is preferably curved as shown) and a spring 52 which are each associated with the fixture 53 which forms the thickness measuring device 50'. The edge 54 of the spring 52 is normally positioned adjacent to, but out of alignment with, a paired light source 55 and photocell 56. As a consequence, documents traversing the transport path 31 will pass between the stationary plate 51 and the spring 52, displacing the spring 52 so that the edge 54 will progressively block the light source 55, varying the resulting electrical signal produced by the photocell 56. The resulting electrical signal may then be analyzed (e.g., a threshold analysis) to determine the thickness (i.e., the number) of the documents then traversing the transport path 31 employing techniques similar to those which are disclosed in U.S. Pat. No. 5,036,190, dated Jul. 30, 1991 (i.e., the edge 54 substitutes for the documents passing between the light source and the photocell).

As with the photocell detection unit 46, if it is determined that two (and only two) documents have issued from between the rollers 45, an effective extraction procedure is deemed to have taken place. If other than two documents are detected by the thickness measuring device 50, 50', an ineffective extraction procedure is deemed to have taken place.

Figure 6C:
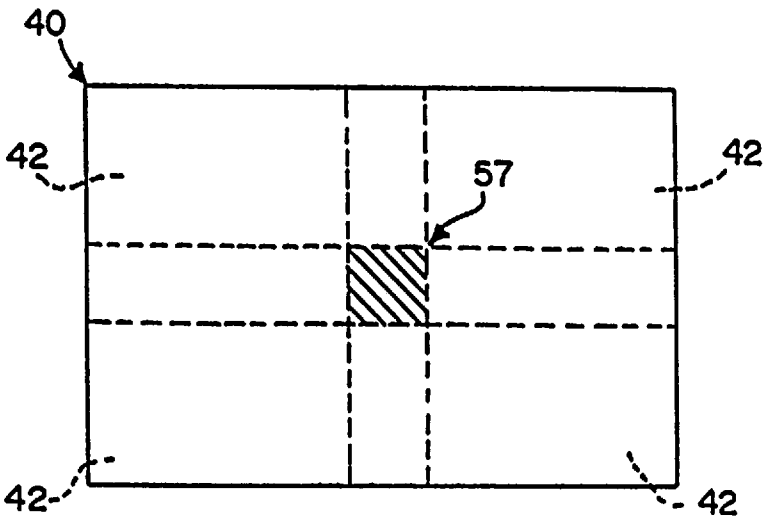
FIG. 6*c* is a schematic plan view of an envelope, with contents, showing a "sweet spot" ideal for thickness measurement.
Figure 6A:
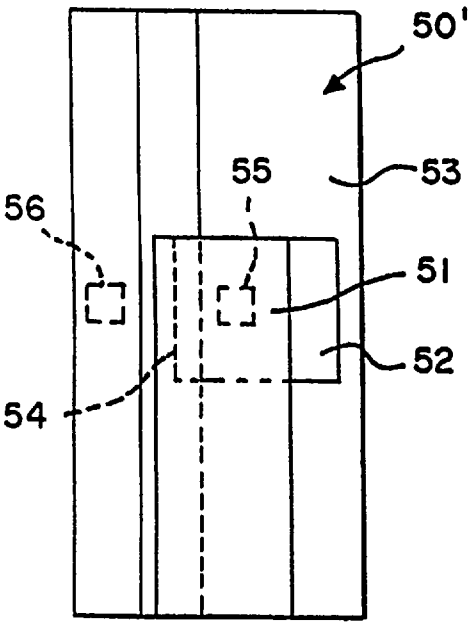
FIG. 6*a* is a side elevation view of an alternative embodiment thickness measuring device for assisting in the extraction function.

To be noted is that the positioning shown for the photocell detection unit 46, the vacuum ports 49, and the thickness measuring device 50' is merely illustrative, and that these devices may follow either the suctioning rollers 35, or the driven rollers 45, as desired. Indeed, as shown in FIG. 6*a*, the thickness measuring device 50' is sufficiently compact to be positioned between the suctioning rollers 35 and the driven rollers 45, if desired, resulting in a compact assembly which is advantageous in processing relatively short documents such as conventional personal checks (i.e., on the order of six inches in length).

This can be accomplished even though the width of the spring 52 is generally small in comparison to the height of the documents which are to be analyzed. Indeed, it has been found that this applies even to the analysis of envelopes with their contents, prior to extraction, allowing the thickness measuring device 50' to replace the thickness measuring device 6 if desired. This is so because an envelope 40 (with contents 42) has been found to exhibit a "sweet spot" 57 (see FIG. 6*c*) where contents 42 will necessarily be present irrespective of their actual location (remote placements are shown in phantom) within the envelope 40. Thus, irrespective of the location of the contents 42 within the envelope 40, such contents can be detected by effectively positioning the relatively small spring 52 of the thickness measuring device 50' (i.e., at the "sweet spot" 57).

Figure 5C:
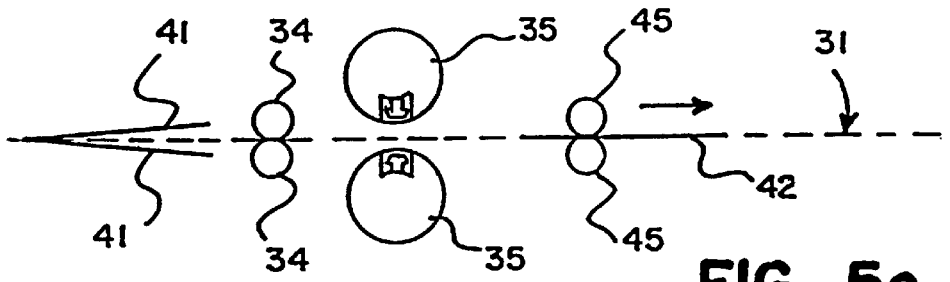

In any event, and referring now to FIG. 5*c*, if it is determined that an effective extraction has taken place, the contents 42 (a pair of documents) are caused to continue along the transport path 31, issuing from between the rollers 45. However, steps are then taken to reverse the direction of rotation for the rollers 34, 35, causing the separated remnants of the envelope 40 to proceed back along the transport path 31. Resulting from the curvature in the transport path 31, developed at the turn 32, such rearward transport then causes the envelope remnants to pass between a pair of belts 58 disposed about a series of rollers 59, for transport toward a disposal mechanism 60 which will be discussed more fully below. Thus, the turned transport path 31 eliminates the need for a gating mechanism at this interface, which would otherwise be required for a linear transport path through the extraction device (which could, for example, be actively controlled by a solenoid or the like responsive to signals received from the photocell detection unit 46, the vacuum ports 49 or the thickness measuring device 50, 50', or passively controlled by being mechanically biased into a position which would normally cross the transport path so that envelopes passing in a forward direction along the transport path would pass the gating mechanism but so that envelopes passing in a rearward direction along the transport path would be diverted by the gating mechanism).

Figure 5D:
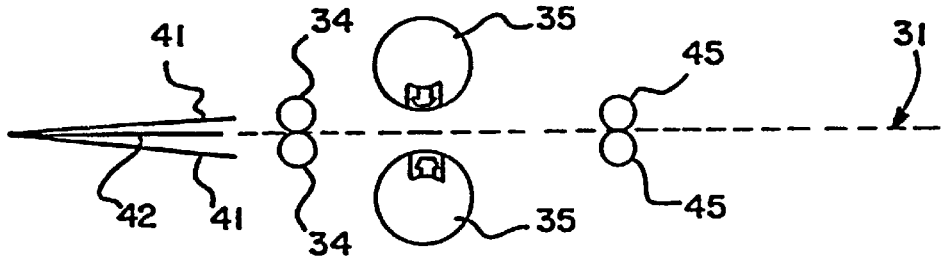

Referring now to FIG. 5*d*, in the event that an effective extraction has not taken place, steps are taken to reverse the direction of rotation for the rollers 34, 35, 45, so that not only the remnants of the envelope 40 are caused to proceed back along the transport path 31, but also any associated documents 42. The reassembled envelope (with contents) will once again be caused to proceed back along the transport path 31, in turn directing the reunited envelope and contents between the paired belts 58 and toward the disposal mechanism 60.

To be noted is that in either case, such operations will return the suctioning rollers 35 to their initial operating position, placing the suction cups 37 in position for entraining the faces of the next envelope to be subjected to extractions Resulting from such operations, the extraction device 30 can operate either step-wise, or continuously, as desired.

Figure 7:
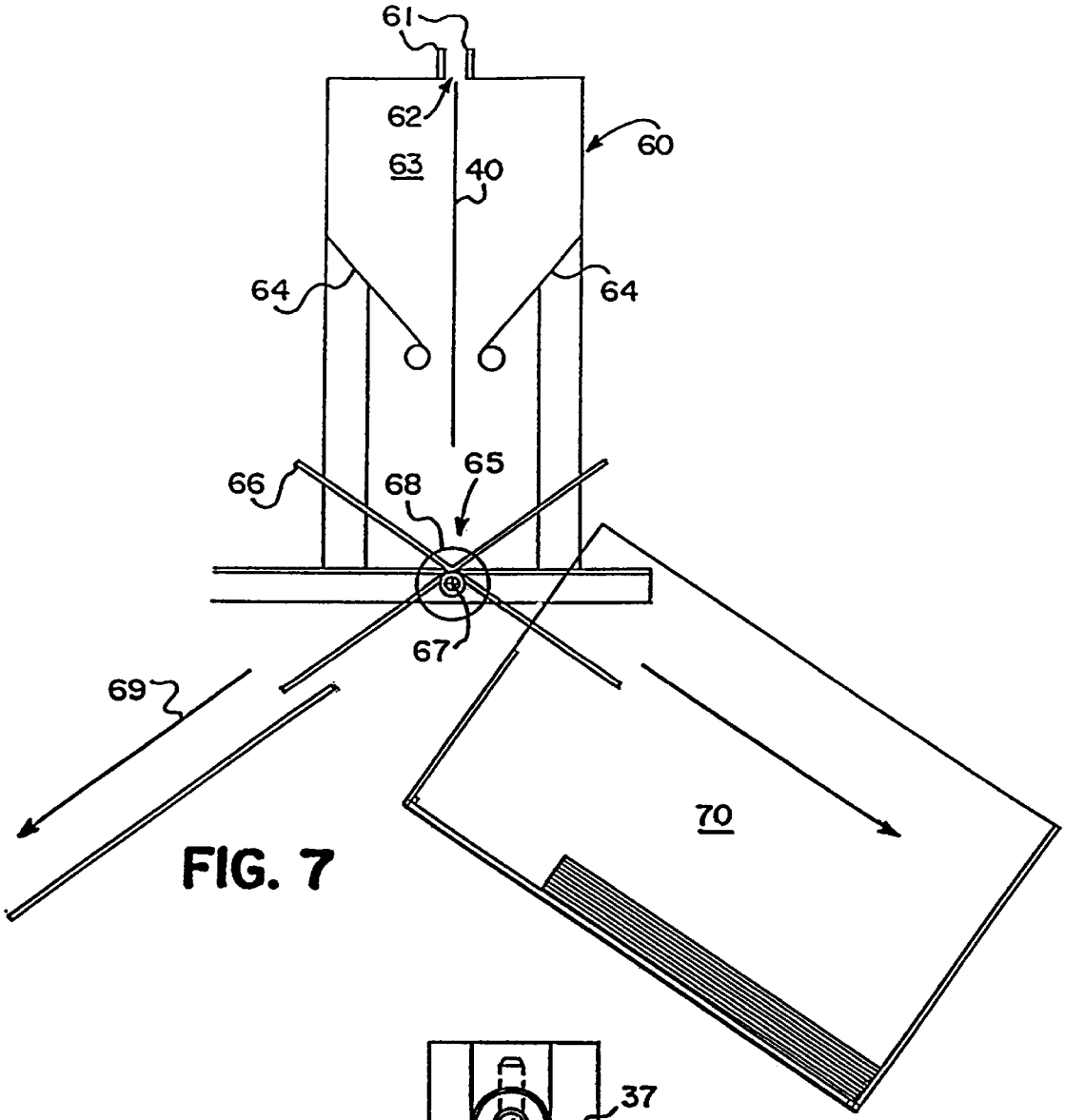
FIG. 7 is a sectional, elevational view of an apparatus for sorting discarded and reunited envelopes which is useful in conjunction with the apparatus of FIG. 4.

Referring now to FIGS. 4 and 7, the disposal mechanism 60 operates to receive either envelope remnants or an envelope which has been reunited with its contents, between a pair of guides 61 which communicate with a drop slot 62. The drop slot 62 communicates with an enclosure 63 having guides 64 for directing received envelope remnants or reunited envelopes and contents toward a tilt gate mechanism 65 which is generally comprised of a plate 66 which can be pivoted in either of two directions about an axle 67 responsive to an appropriate drive mechanism 68 (e.g., a motor or solenoid drive). In the event that envelope remnants are received by the disposal mechanism 60, steps are taken to rotate the plate 66 in a first direction which causes the envelope remnants to proceed along the plate 66 and into a trash bin 69. In the event that an envelope which has been reunited with its contents is received by the disposal mechanism 60, steps are taken to rotate the plate 66 in the opposite direction, so that the reunited envelope and contents will proceed along the plate 66 and toward a stacking bin 70. Signals for operating the drive mechanism 68 which causes such rotation of the plate 66 are receivable from the photocell detection unit 46, the vacuum ports 49 or the thickness measuring device 50, 50' which have previously been described. If desired, the envelope remnants and reunited envelopes and contents may be monitored (e.g., using optical sensing devices) as they progress through the disposal mechanism 60, to verify and regulate their proper handling.

Figures 8A, 8B:
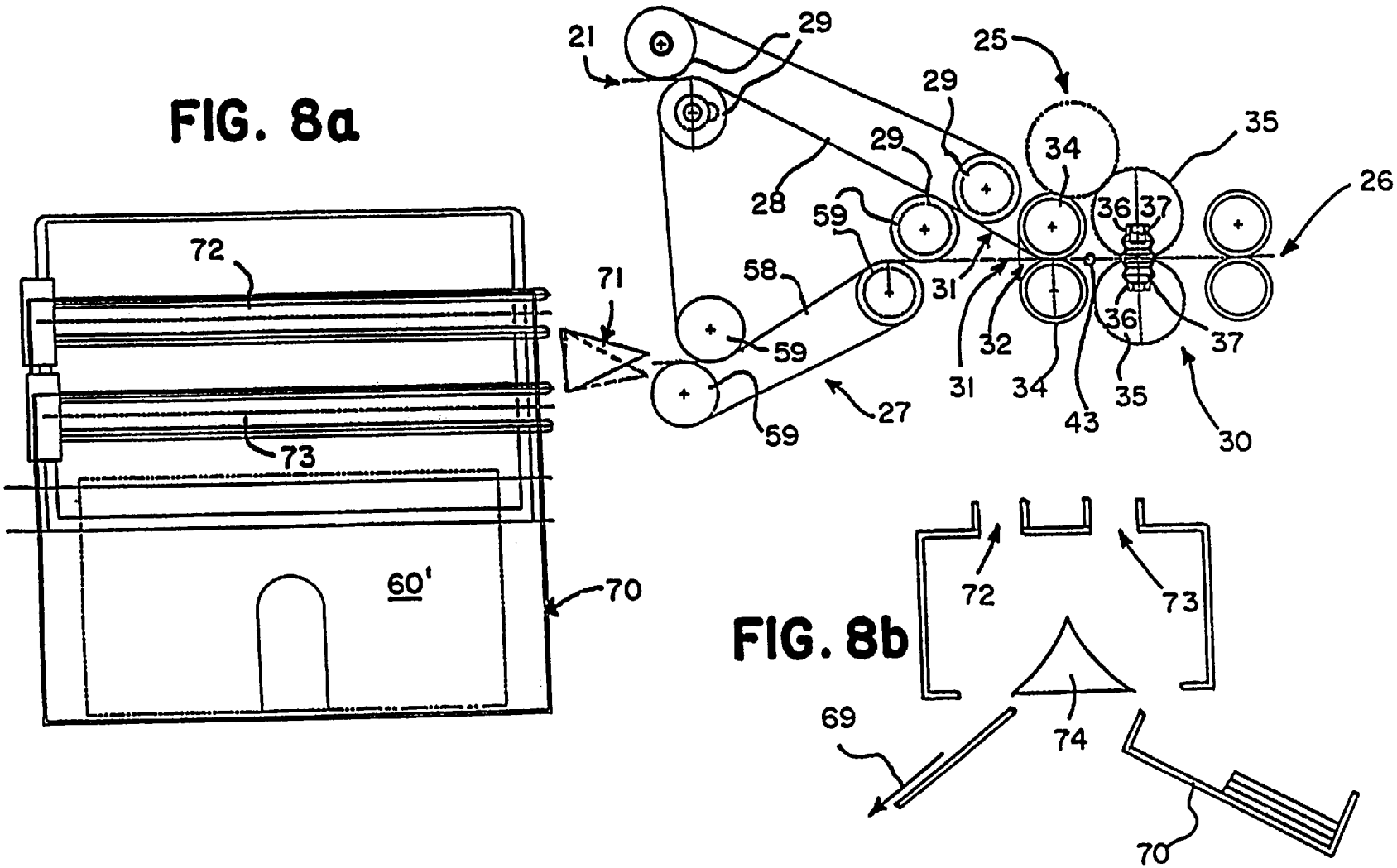
FIG. 8*a* is a top plan view of a first alternative embodiment apparatus for sorting discarded and reunited envelopes.
FIG. 8*b* is a sectional, elevational view of the alternative embodiment sorting apparatus of FIG. 8*a*.
Figure 9:
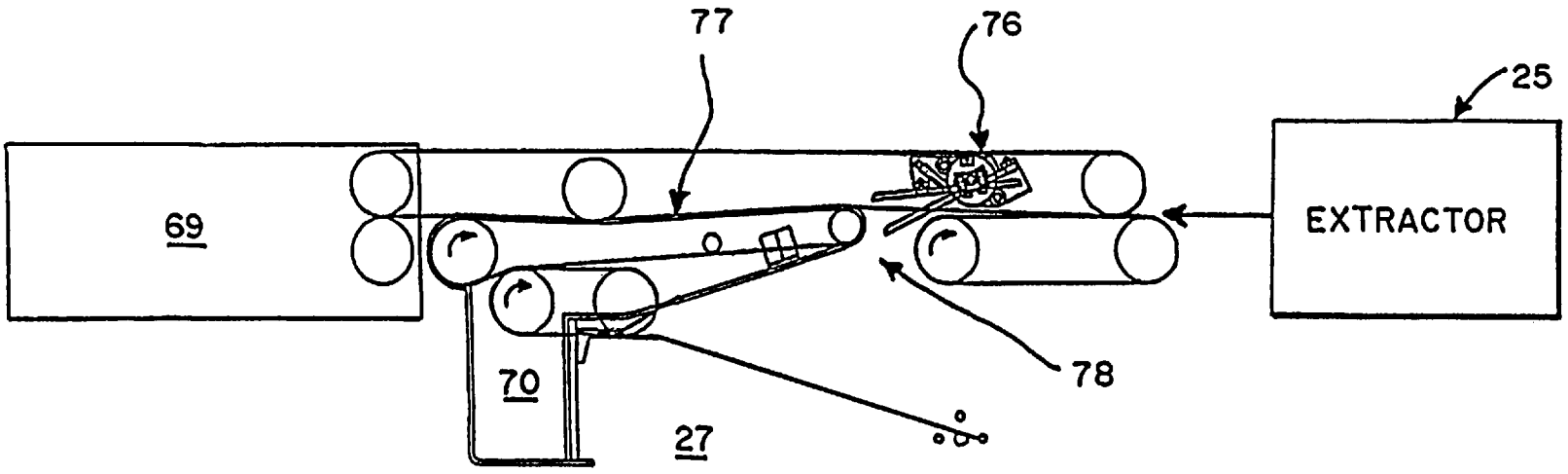
FIG. 9 is an enlarged, schematic plan view of a second alternative embodiment apparatus for sorting discarded and reunited envelopes.

Alternative embodiment disposal mechanisms 60', 60" are shown in FIGS. 8*a* and 8*b*, and FIG. 9, which can also operate to receive either envelope remnants or an envelope which has been reunited with its contents from the extraction device 30. In the alternative embodiment of FIGS. 8*a* and 8*b*, the belts 58 communicate with a gating mechanism 71 (e.g., a solenoid actuated gate) for directing envelope remnants to a first drop slot 72, and for directing reunited envelopes and contents to a second drop slot 73. The tilt gate mechanism 65 is additionally replaced with a fixed guide 74 for directing envelope remnants received from the drop slot 72 toward the trash bin 69, and for directing reunited envelopes and contents received from the drop slot 73 toward the stacking bin 70. In the alternative embodiment of FIG. 9, the belts 58 communicate with a gating mechanism 76 (e.g., a solenoid actuated gate) for directing envelope remnants along a first transport path 77, and for directing reunited envelopes and contents along a second transport path 78. The first transport path 77 communicates with the trash bin 69, while the second transport path 78 communicates with the stacking bin 70. The gating mechanisms 71, 76 are advantageously controlled responsive to signals received from the photocell detection unit 46, the vacuum ports 49 or the thickness measuring device 50, 50' which is employed.

Figure 10:
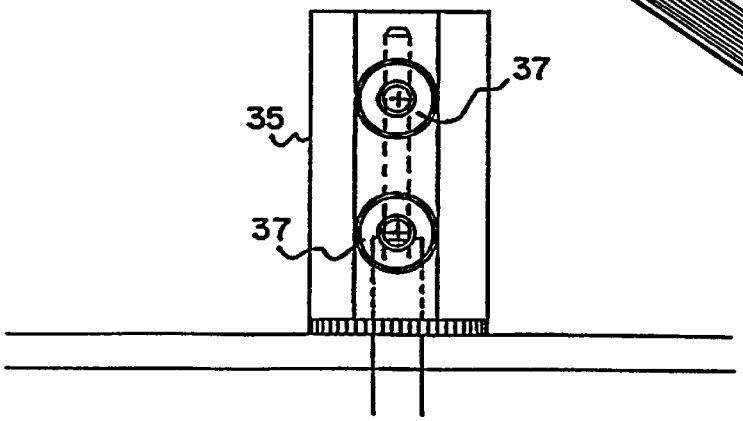
FIG. 10 is a side elevational view showing one of the suctioning rollers of the apparatus of FIG. 4.

The extraction device 30 should preferably be capable of accommodating any of a number of different types of envelopes, and operating conditions. Consequently, although only one suction cup 37 has previously been described in connection with the suctioning rollers 35, it is generally preferable to provide each of the suctioning rollers 35 with plural suction cups 37, positioned at spaced locations along the length of each suctioning roller 35. FIG. 10 illustrates a suctioning roller 35' which incorporates a pair of suction cups 37, and which should be sufficient for most applications.

Plural suction cups 37 are preferred since this tends to ensure that at least one of the two suction cups 37 which are provided will entrain each of the faces 41 of the envelope 40 being processed. This may be used to account for irregularities in the porosity of the envelope faces resulting from differences in envelope construction, primarily due to the number of paper thicknesses which comprise a particular envelope face (e.g., fold and glue lines). This may also be used to account for openings (i.e., windows) in the faces 41 of the envelope 40, which are commonly used to reveal mailing addresses or account identifying information. By separately valving plural suction cups 37, such irregularities can be accommodated as envelopes pass between the suctioning rollers 35, increasing the reliability of the extraction procedure.

Figure 11:
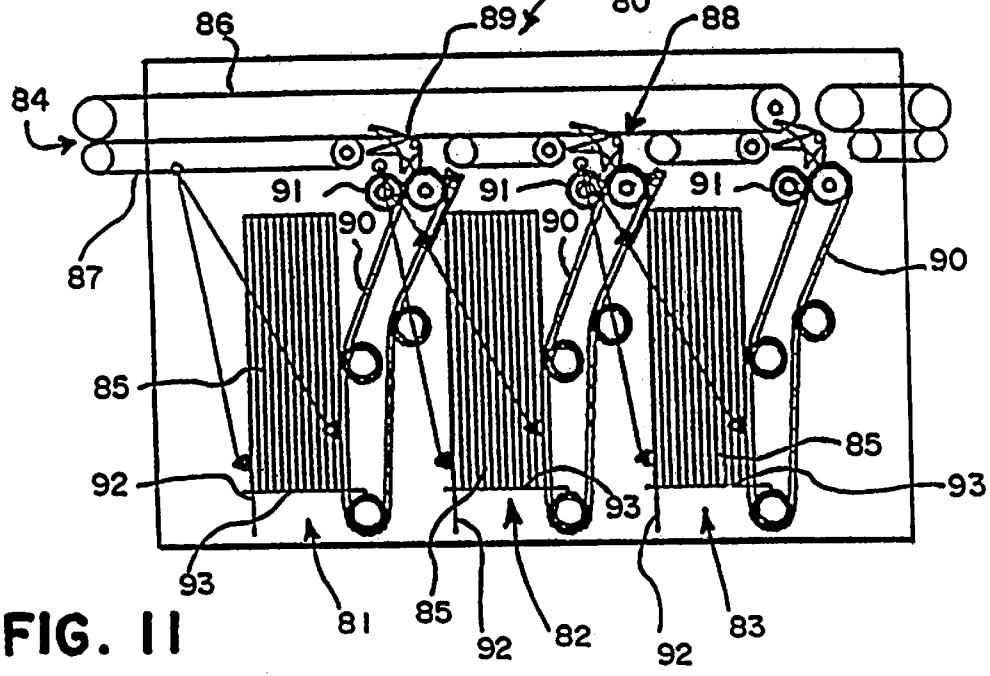
FIG. 11 is an enlarged, schematic plan view of portions of the apparatus of FIG. 1, showing the stackers which follow the extraction device.

Irrespective of the extraction apparatus which is employed, extracted and paired documents are then delivered from the discharge point 26 of the extraction station 25 to a distribution station 80 for issuing the extracted documents from the apparatus 1. The distribution station 80 which has been selected for illustration in FIGS. 1, 3 and 11 preferably incorporates a series of three stacking units 81, 82, 83, which serially operate to divert documents from the processing path 84 to a series of bins 85 for receiving such documents. As will be discussed more fully below, any of a number of criteria may be selected for diverting documents from the processing path 84. The stacking units 81, 82, 83 are structurally identical to one another. Extracted documents are received between a pair of belts 86, 87 for direction along a transport path 88 which extends past each of the stacking units 81, 82, 83. Each stacking unit 81, 82, 83 is provided with a gating mechanism 89 for selectively diverting documents from the transport path 88 and toward the stacking unit which has been selected. Each gating mechanism 89 (e.g., a solenoid actuated gate) is capable of separate operation responsive to electrical signals for controlling the routing of documents passing along the transport path 88, as will be discussed more fully below.

Referring now to the first stacking unit 81 in the series, documents diverted from the transport path 88 are introduced between a pair of belts 90, 91 for introduction into the stacking bin 85. Such documents are received between the larger belt system 90 and a spring-loaded backing plate 92. An edge guide 93, which serves as a stop, is provided for receiving the leading edges of the received documents. As documents are received between the belt system 90 and the spring-loaded backing plate 92, the spring-loaded backing plate 92 will be biased rearwardly, progressing into the bin 85 and forming the desired stack of documents. To be noted is that the smaller belt system 91 can be replaced with a single roller, if desired for a particular application.

Figure 12:
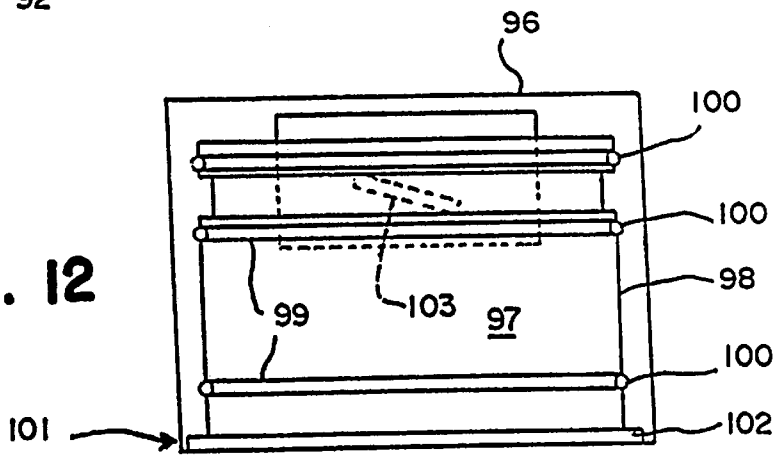
FIG. 12 is a side elevational view of the justification device of FIG. 4.

For some applications, it is sufficient for the stacking units 81, 82, 83 to receive paired documents delivered from the extraction device 30, and to stack the paired documents according to their characteristics. However, for other applications it may be preferable to operate upon separate (single) documents. This not only permits the documents to be separately accessed by the distribution station 80, for stacking purposes, but also allows the documents to be serially discharged from the distribution station 80, for presentation to the remittance processing station 2 as will be discussed more fully below. Means for separating paired, parallel documents into serially discharged, separated documents are disclosed in U.S. Pat. No. 4,863,037, with reference to the separation station which is described. However, a somewhat more compact means for accomplishing a similar function is achievable with the justification device 95 which is illustrated in FIGS. 4 and 12. The justification device 95 also operates to register (justify) the documents with a desired reference level, which serves to significantly neaten the stacks which are produced by the stacking units 81, 82, 83 (which facilitates stack handling).

In operation, and as shown, the justification device 95 receives paired documents from the extraction device 30. To this end, documents discharged from the driven rollers 45 of the extraction device 30 enter the justification device 95 between a fixed guide 96 and a first drum 97. The periphery 98 of the drum 97 incorporates a series of grooves 99 for receiving a corresponding series of O-rings 100 which are formed of a friction-producing material. The base 101 of the drum 97 further includes a flange 102 which, as will be discussed more fully below, serves as a reference surface for justifying documents received from the extraction device 30.

Under the influence of the driven rollers 45 of the extraction device 30, paired documents entering between the guide 96 and the drum 97 are passed to a first angled roller 103 which extends through the guide 96 and into contact with the drum 97. The materials used in forming the O-rings 100 and the angled roller 103 are selected so that a greater amount of friction is developed between the angled roller 103 and the paired documents which are then passing through the justification device 95 than the amount of friction which is developed between the paired documents and the O-rings 100 of the drum 97. Resulting from this, the document which is then in contact with the angled roller 103 can be moved (shifted) relative to the remaining document (which is then in contact with the drum 97).

The generally downwardly directed angle exhibited by the angled roller 103 operates to urge the document in contact with the angled roller 103 downwardly and into contact with the flange 102 of the drum 97. By operating the angled roller 103 at a speed of rotation which exceeds the speed of rotation for the drum 97, this document is additionally shifted forward relative to the other document, in an amount which is proportional to the difference in rotational rates established for the angled roller 103 and the drum 97 (allowing an adjustment of the shift which is then developed). Preferably, the angled roller 103 is positioned at the "sweet spot" previously described in conjunction with the extraction device 30 (FIG. 6*c*), to ensure that both documents are effectively engaged and operated upon.

Following this, the relatively shifted documents are transferred from between the guide 96 and the drum 97 and between a second guide 104 and a second drum 105. The drum 105 preferably corresponds to the drum 97, except that the O-rings 100 of the drum 97 are omitted. Resulting from this, as the documents are passed between the guide 104 and the drum 105 (responsive to rotation of the first angled roller 103), the documents are caused to encounter a second angled roller 106 which extends through the guide 104 and into contact with the drum 105. The angled roller 106 is preferably formed of a material similar to the angled roller 103, but preferably rotates at a rate which corresponds to the rate of rotation of the associated drum 105.

As a consequence of this, as the leading (previously shifted and justified) document encounters the angled roller 106, this document is caused to continue along the drum 105, resting upon the associated flange 102. Thereafter, the second document will encounter the angled roller 106 (which is now on the opposite side of the document pair). The generally downwardly directed angle exhibited by the angled roller 106 operates to urge the second document downwardly and into contact with the flange 102 of the second drum 105, justifying the second document relative to the reference surface. Once again, the angled roller 106 is preferably positioned at the "sweet spot" previously described in conjunction with the extraction device 30 (FIG. 6*c*), to ensure that both documents are effectively engaged and operated upon.

As a result of the foregoing, shifted and justified documents will be discharged from the justification device 95, exiting from between a final pair of discharge rollers 107. To be noted is that the curvature of the drums 97, 105 serves to curl the documents as they are being operated upon, increasing their structural integrity and facilitating in the shifting and justification procedures which are to be accomplished. Also to be noted is that the justification device 95 is optionally provided, and can be used at other locations within the apparatus 1, or in conjunction with other document processing equipment,as desired.

The stacking units 81, 82, 83 of the distribution station 80 can be employed to accomplish any of a number of desired sorting functions. Generally speaking, envelopes containing documents other than a paired invoice and check will have already been removed from the apparatus 1 by the sorting device 12 previously described. However, one particularly useful sorting function which can be implemented with the stacking units 81, 82, 83 involves the orientation of the documents which are being processed. As previously indicated, the apparatus 1 of the present invention is configured for direct association with a remittance processing device. As a result, an operator will generally be seated at the remittance processing station 2, at 108, to view received documents so that data shown on the documents may be effectively entered. The orientation-of the documents being presented to the operator therefore becomes relevant.

For example, it has been found that for "windowed" envelopes (those containing openings for viewing an address or the like), up to 70% of the envelopes which are processed through the apparatus 1 will include both an invoice and a check which are properly oriented (upright and facing the operator). Productivity can therefore be enhanced by providing only these documents to the operator of the remittance processing station 2, while removing all other documents from the processing path 84. This would be readily detectable by signals received from the orientation determining device 10, which had previously operated upon the documents while in their envelopes, or a similar orientation determining device located downstream from the extraction station 25, to operate upon the documents following their extraction from the envelopes. Documents in other orientations would then be diverted from the processing path 84 responsive to electrical signals received from the orientation determining device, leaving only correctly oriented documents for remittance processing (presumably at an enhanced rate).

If desired, misoriented documents could not only be diverted from further processing, but could also be directed to different stacking units 81, 82, 83 of the distribution station 80. For example, all inverted, forward facing documents could be diverted to the stacking unit 81, while all inverted, rearwardly facing documents, and all upright, rearwardly facing documents could be diverted to the stacking units 82, 83, respectively. This would enable the separate processing (presumably at an enhanced rate) of uniformly oriented documents either using the remittance processing station 2 (the operator can simply reach to the left and obtain the grouped documents from the stacking units) or using a remotely located remittance processing device, as desired.

Other sorting functions are also clearly possible. For example, other types of documents which are not appropriate for subsequent processing may similarly be diverted from the processing path 84, if desired (e.g., two documents, neither of which is a check). To this end, although three stacking units 81, 82, 83 have been shown, more or fewer stacking units may be employed if desired.

Figure 13:
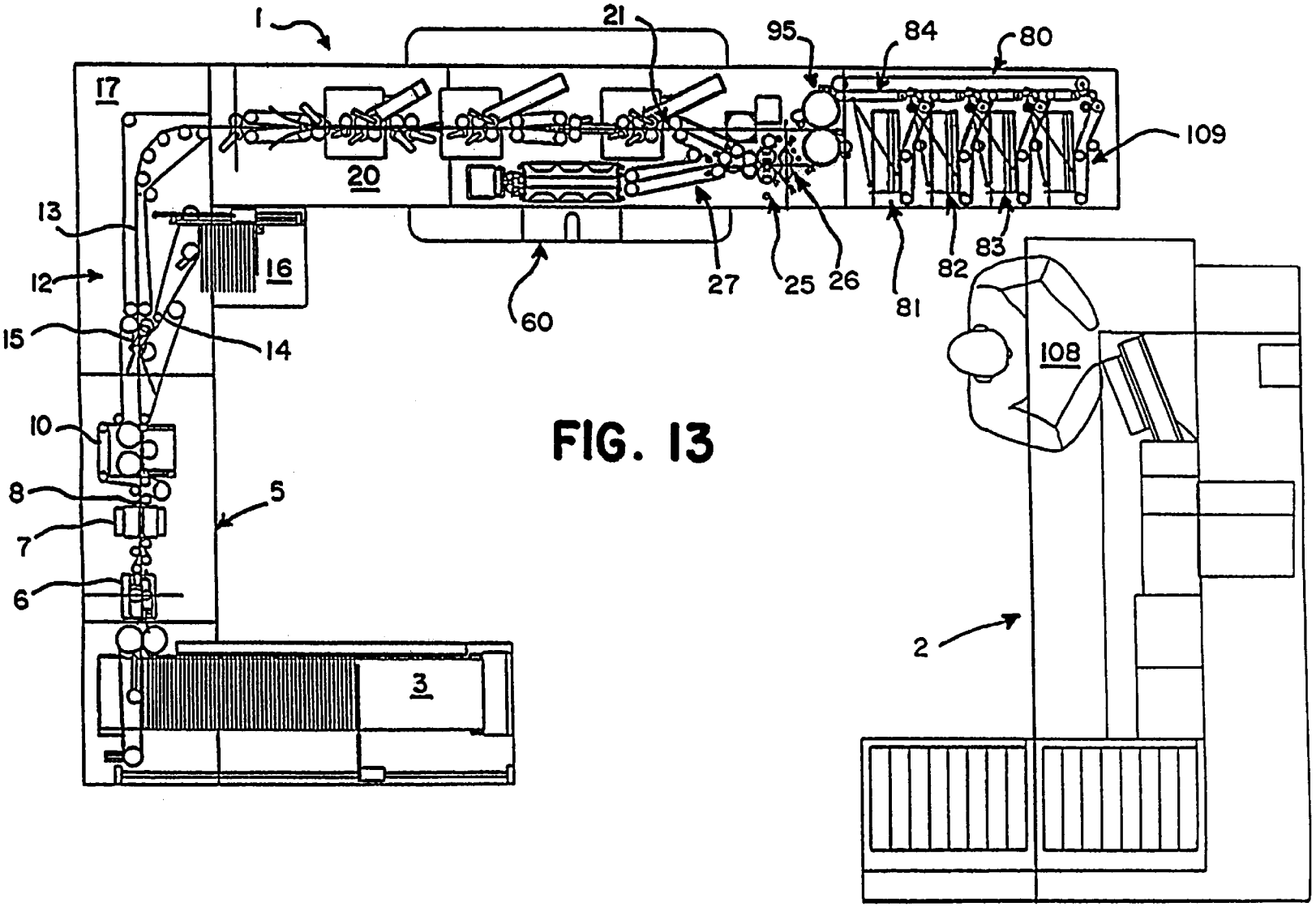
FIG. 13 is a schematic, plan view of an alternative embodiment apparatus produced in accordance with the present invention.

Making use of a fourth stacking unit 109, paired invoices and checks may be grouped (sorted) according to each of the four possible orientations for such documents. In such case, it would be possible to end further processing of the extracted documents by the apparatus 1, leaving sorted documents for subsequent remittance processing according to their orientation (preferably making use of a remittance processing device stationed adjacent to the bins 85 of the stacking units). Such an embodiment is illustrated in FIG. 13 of the drawings.

However, further versatility in automated processing is accomplished by causing appropriate documents (either some or all of the document pairs depending upon the operation which is desired) to proceed along the processing path 84, for subsequent delivery to the remittance processing station 2 as previously described. To this end, the processing path 84 communicates with a document delivery system 110.

Figure 14:
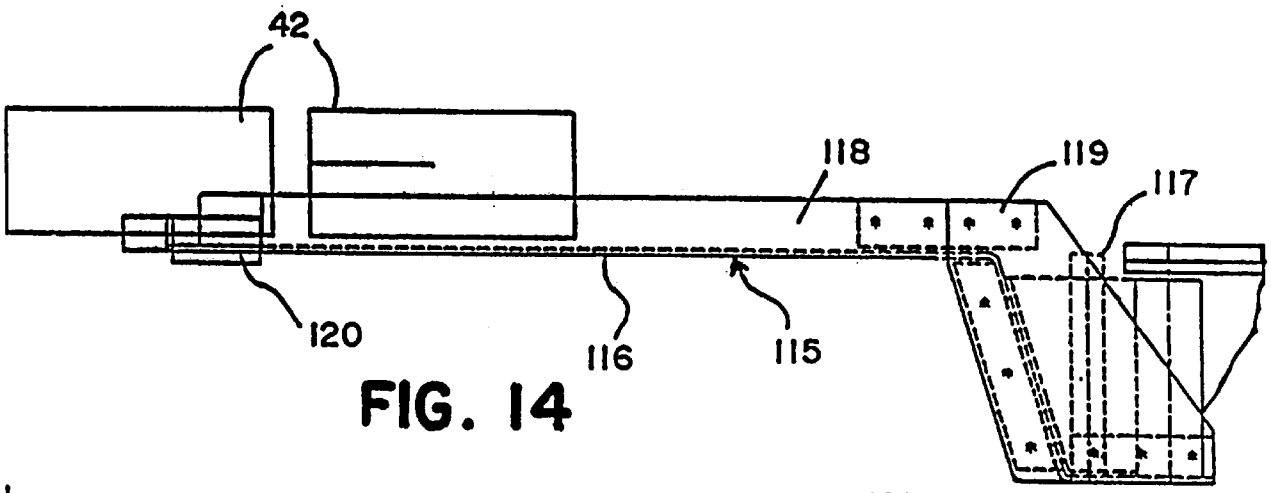
FIG. 14 is a side elevational view of the delivery arm which communicates with the remittance processing station.

Initially, documents discharged from the processing path 84 are delivered between a pair of belts 111 disposed about nip-forming pairs of rollers 112, 113. In its simplest form, the output defined by the rollers 113 in turn communicates with an adjustable arm 115 for delivering documents to the remittance processing station 2. Referring to FIG. 14, the arm 115 generally takes the form of a frame 116 which is pivoted for rotation, at 117, immediately following the discharge point defined by the rollers 113. Associated with the frame 116 are a pair of belts 118 which are disposed about paired input rollers 119 and paired output rollers 120. As a consequence, documents are transferred from the belts 111 to the arm 115 by appropriately aligning the output rollers 113 with the input rollers 119 of the arm 115. If desired, a guide 121 may be positioned at this interface to assist in this transfer. Preferably, the height of the belts 118 (and the rollers 120) is minimal, for engaging bottom portions of the documents 42 which are being handled while leaving upper portions of the documents 42 exposed for viewing by the operator seated at the remittance processing station 2.

Documents will then travel up the arm 115 to the output rollers 120, for introduction into the remittance processing station 2. As previously discussed, available remittance processing devices conventionally include two different types of inputs for receiving documents for processing. One such input constitutes a longitudinal feed path which proceeds across a window 122 which is provided for viewing by the operator. In such case, the arm 115 would be adjusted so that the output rollers 120 communicate with an input 123 for this longitudinal feed path, enabling direct communication between the two units. Alternatively, the arm 115 could be adjusted so that the output rollers 120 communicate with an input 123' for communicating with the stacking mechanism which is associated with the longitudinal feed path, allowing documents to be stacked for introduction into the remittance processing station 2 responsive to demand (providing a buffering function in this mode). However, in either case, this would require modification of the remittance processing station 2 to receive documents (from the arm 115) within its longitudinal feed path, and is therefore presently less preferred. Another input associated with the remittance processing station 2, generally referred to as a "drop slot", is constituted by an opening 124 for receiving documents from above, for introduction into the remittance processing station 2. In such case, the arm 115 would be adjusted so that the output rollers 120 are positioned above the drop slot of the remittance processing station 2, so that documents discharged from the arm 115 are able to enter the drop slot for processing in otherwise conventional fashion. A guide 125 is preferably positioned beyond the output rollers 120 to facilitate this process. Since this would not require modification of the remittance processing station 2, this mode of operation is presently preferred for communicating with existing remittance processing devices.

In either case, the arm 115 is made adjustable to accommodate different types of remittance processing devices, and to effectively mate with the remittance processing station 2 which is employed irrespective of differences in floor plan. It should be noted that although the remittance processing station 2 is shown at a right angle relative to the transport path 84, this orientation is primarily selected for convenience in floor planning, and may be freely varied according to need.

In addition to variations in the configuration of and the location for the remittance processing station 2, it should be noted that the apparatus 1 can, if desired, communicate with a plurality of remittance processing devices. This configuration finds particular utility where the rate at which the apparatus 1 can extract documents from envelopes exceeds the rate at which the remittance processing station 2 can be operated to achieve its desired functions (which will generally occur due to the manual operations which are associated with the remittance processing station 2). This differential is advantageously utilized by providing a series of remittance processing devices in communication with the apparatus 1.

Figure 15:
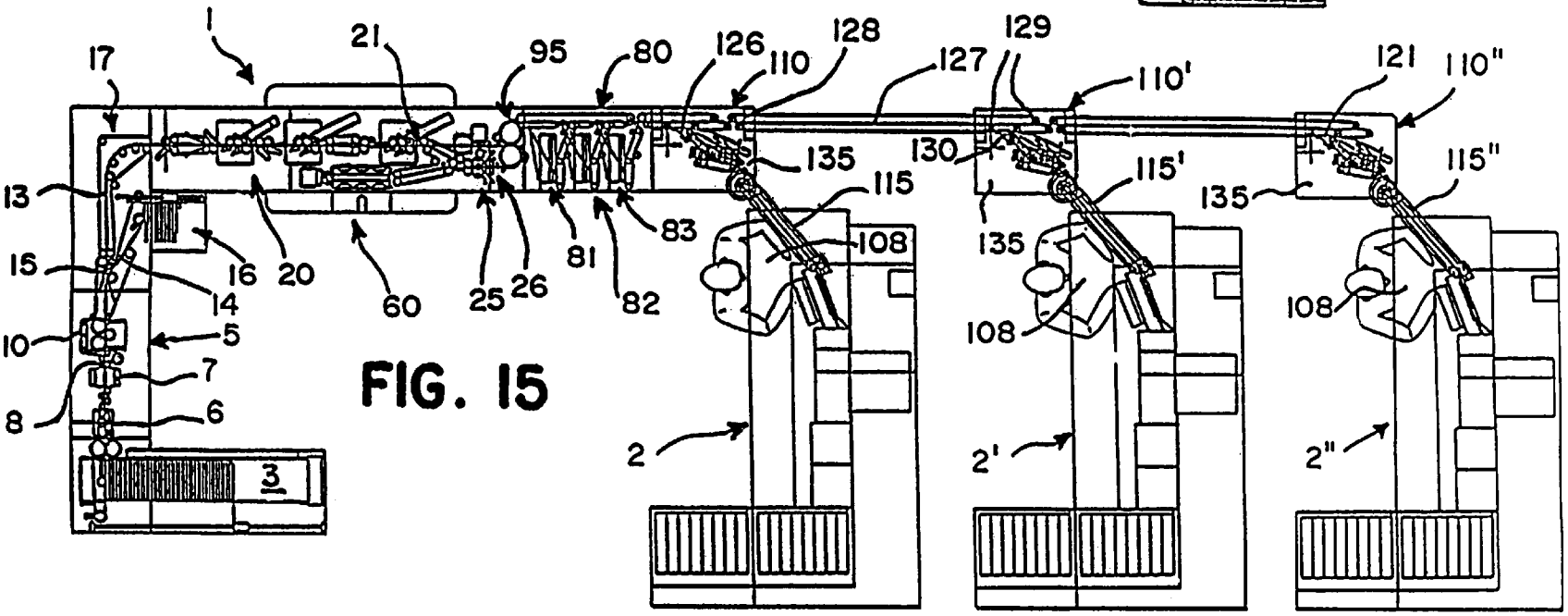
FIG. 15 is a schematic, plan view of another alternative embodiment apparatus produced in accordance with the present invention, which communicates with a plurality of remittance processing devices.

One such configuration is schematically illustrated in FIG. 15 of the drawings, which shows a single apparatus 1 for extracting documents in communication with three remittance processing stations 2, 2', 2". The only modification which is necessary to implement this configuration is to gate the delivery of documents to the several document delivery systems 110, 110', 110" associated with the remittance processing stations 2, 2', 2" so that documents are sequentially delivered to the several remittance processing devices which are available (either serially or upon demand).

This is accomplished, for example, by providing a first gate 126 (e.g., a solenoid operated gate) between the output rollers 113 of the distribution station 80 and the input rollers 119 of the arm 115. The gate 126 is made pivotable between a position which diverts documents to the arm 115, and a position which passes documents on to a pair of belts 127 disposed about paired rollers 128, 129. A second gate 130 is provided following the rollers 129 so that documents exiting from between the belts 127 can either be diverted toward the arm 115' of the second remittance processing station 2', or the arm 115" of the third remittance processing station 2". Although three remittance processing devices are shown in this illustrative embodiment, it is to be understood that other numbers, in other configurations, may be employed in accordance with the present invention as desired.

Irrespective of the number of remittance processing stations 2 which communicate with the apparatus 1, it is nevertheless still possible for the rate at which documents are extracted from the envelopes to exceed the rate at which documents can be processed by the remittance processing devices under given circumstances. Indeed, such a condition will often be preferred in order to ensure that an adequate supply of documents is continuously made available so as to maintain a consistent work flow in operating the remittance processing station 2 (or stations 2, 2', 2", irrespective of their number). For this reason, a buffer mechanism 135 preferably forms part of the document delivery system 110 (and the document delivery systems 110', 110" if employed), interconnecting the belts 111 which receive the documents from the transport path 84 with the adjustable delivery arm 115.

Figure 16:
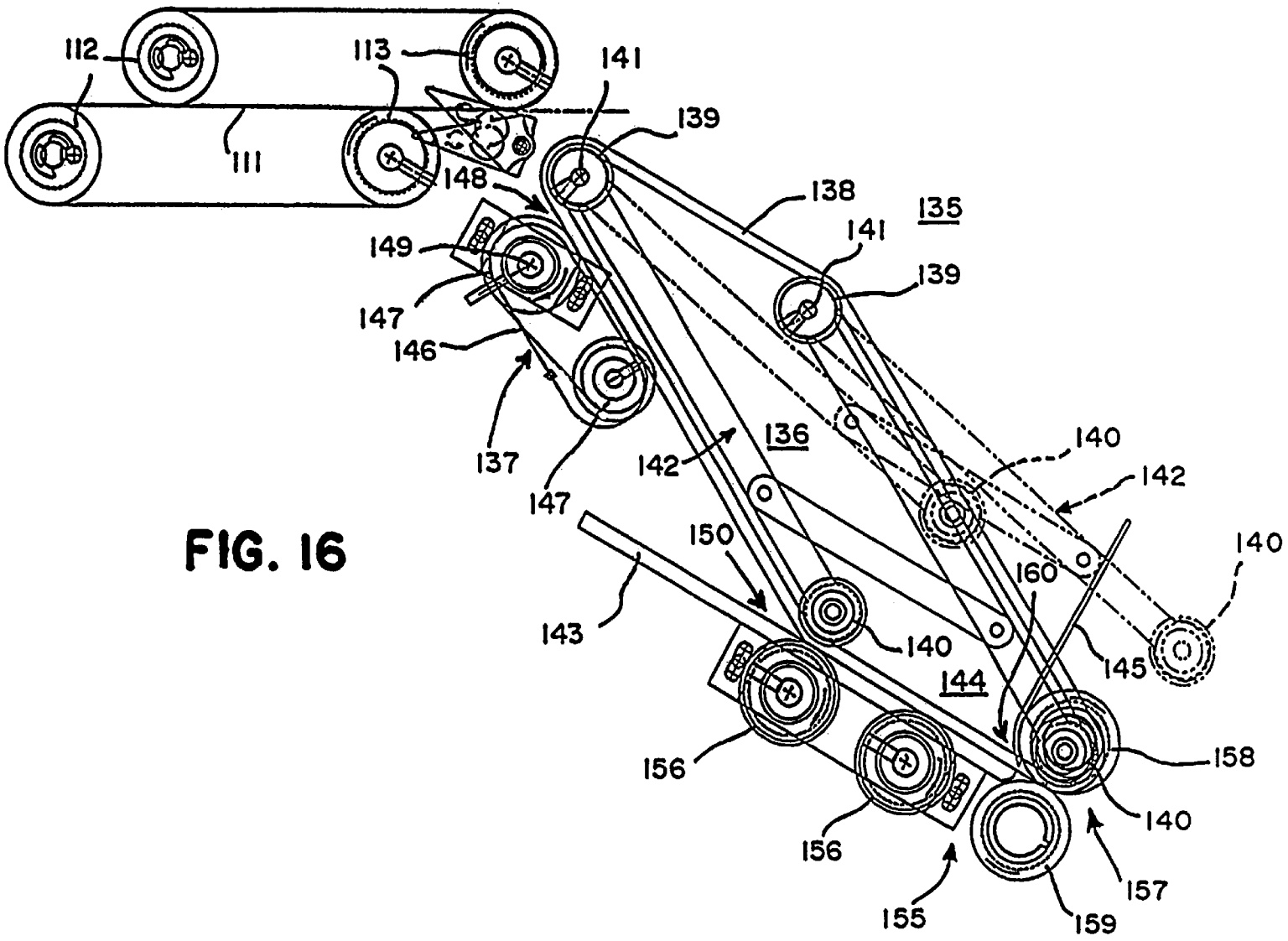
FIG. 16 is an enlarged, schematic plan view of a document buffer for interconnecting the extraction apparatus and the remittance processing station.

Referring to FIG. 16, the buffer mechanism 135 is positioned to receive documents diverted by the gate 126, which. had previously operated to deliver documents directly to the arm 115. However, in this case, the diverted documents are delivered between a pair of transport mechanism 136, 137. The transport mechanism 136 is generally comprised of a belt 138 disposed about a series of rollers 139, 140. Two of the rollers 139 are pivoted about fixed positions, defined by bearings 141. The remaining two rollers 140 are operatively interconnected with the bearings 141 by a frame 142 which operates to maintain the rollers 140 in an orientation which is generally parallel to the bearings 141, and to a fixed guide 143. As a result of this, as documents are received between the rollers 140 (actually the belt 137) and the fixed guide 143, the frame 142 is caused to retract to intermediate positions (shown in phantom) within a buffer bin 144 which is generally defined by the fixed guide 143 and an edge stop 145.

The transport mechanism 137 is also comprised of a belt 146 disposed about opposing rollers 147, which are positioned relative to the belt 138 of the transport mechanism 136 so as to define a nip 148 for receiving documents from the gate 126. To be noted is that the transport mechanism 137 is pivoted, at 149, in order to maintain effective contact between the belt 146 of the transport mechanism 137 and the belt 138 of the transport mechanism 136 irrespective of movements of the transport mechanism 136 relative to the fixed guide 143. Also to be noted is that a similar function can be achieved by replacing the transport mechanism 137 with a single roller, which is similarly pivoted at 149 in order to maintain contact with the transport mechanism 136.

As a result, documents received from the gate 126 are initially introduced between the transport mechanisms 136, 137, thereafter passing to a nip 150 defined between the transport mechanism 136 and the fixed guide 143. The belts 138, 146 may be interleaved with one another to corrugate (curl) the documents as they pass from between the belts 138, 146, facilitating their transfer to the nip 150 and across the intervening open space. In any event, documents are in this fashion delivered to and received within the buffer bin 144, and are stacked within the buffer bin 144 as desired.

To deliver documents from the buffer bin 144, a demand feed mechanism 155 is associated with the fixed guide 143 which operates to withdraw documents from the buffer bin 144 for delivery to the arm 115 (responsive to demand resulting from operations of the remittance processing station 2). The demand feed mechanism 155 generally includes a pair of pre-feed rollers 156 for urging documents toward a friction separator 157.

The pre-feed rollers 156 operate to pass the documents which are then adjacent to the fixed guide 143 from the buffer bin 144 and through a throat 160 defined between the edge stop. 145 and the fixed guide 143. Following this, the documents are introduced to the friction separator 157, entering between a pair of rollers 158, 159 including a roller 158 formed of a material which exhibits an intermediate coefficient of friction and a roller 159 formed of a material which exhibits a high coefficient of friction. Resulting from this difference in the coefficients of friction for the two rollers 158, 159, the document which is then closest to the fixed guide 143 will be advanced relative to the next, nearest adjacent document, causing the first document to issue from between the rollers 158, 159. Thereafter, the next (second) document will be caused to issue from between the rollers 158, 159, and so on. By regulating the transport speed for the belts 118 of the arm 115, previously paired documents extracted from the envelopes and introduced into the buffer mechanism 135 will be serially discharged from the buffer mechanism 135 for delivery along the arm 115, and to the remittance processing station 2 (at a rate, and separated by a gap, which will vary responsive to the transport speed selected for the belts 118).

Through selective operations of the demand feed mechanism 155, responsive to appropriate signals associated with the remittance processing station 2, documents may be delivered from the apparatus 1 to the remittance processing station 2 in accordance with the speed of the operator stationed at the remittance processing station 2. This can include signals derivable from the remittance processing station 2 (an interfaced electrical connection), a foot pedal associated with the remittance processing station 2, or sensors (e.g., optical detectors) associated with the arm 115 as will be discussed more fully below. Since the demand feed mechanism 155 will operate at differing rates responsive to demand, and the transport mechanism 136 will operate at a constant rate established for the apparatus 1, the contents of the buffer bin 144 will constantly (dynamically) be changing.

Certain precautions should be taken when feeding paired documents into the buffer bin 144 and between the transport mechanism 136 and the fixed guide 143. Otherwise, when feeding the paired documents to the nip 150, one or both of the documents may not be effectively received between the transport mechanism 136 and the fixed guide 143, or the documents may be shifted relative to one another to such an extent that subsequent operations of the demand feed mechanism 155 will be hindered. To overcome this, two precautions are advisable.

First, the paired documents are preferably shifted relative to one another so that the leading document may first be engaged between the transport mechanism 136 and the fixed guide 143, and positively driven to the edge stop 145, and so that the trailing document may thereafter be engaged between the transport mechanism 136 and the fixed guide 143, to separately and positively drive the trailing document (and all subsequent documents) to the edge stop 145. This is advantageously accomplished by the justification device 95, which operates to shift the documents relative to each other as is desired. The justification device 95 also operates to justify the documents to a level reference surface, which serves to improve the uniformity of the stack of documents which is developed within the buffer bin 144, and to assist in the uniform withdrawal of documents from the buffer bin 144 responsive to operations of the demand feed mechanism 155.

To be noted is that the parallel relationship which is developed between the rollers 140 of the transport mechanism 136 and the fixed guide 143 also operates to contribute to the foregoing. This is because a point contact with the documents being operated upon, against the fixed guide 143, will tend to cause one of the documents to advance relative to the other (which is generally an undesirable result). To correct this, a line-contact is maintained between the transport mechanism 136 and the fixed guide 143, avoiding such a result. For this reason, the transport mechanism 136 preferably takes the general shape of a parallelogram, rather than the more triangular transport mechanisms associated with other stacking units (e.g., the stacking units 81, 82, 83).

Second, the pre-feed rollers 156 are preferably interconnected with the remainder of the demand feed mechanism 155 by a one-way clutch which permits the pre-feed rollers 156 to be overdriven relative to the rate of operation of the demand feed mechanism 155. This operates to permit documents to be effectively driven into the buffer bin 144, and against the edge stop 145, irrespective of the mode (speed) of operation of the demand feed mechanism 155 (e.g., at stop, or possibly at a rate which is slower than the rate of operation for the transport mechanism 136). Such considerations are particularly important when receiving a first document between the transport mechanism 136 and the fixed guide 143, since this first document will encounter the resistive surface of the pre-feed rollers 156, while remaining documents will encounter the relatively slippery surface of an earlier-fed document.

Following serial discharge from the demand feed mechanism 155, separate documents are caused to traverse the arm 115, progressing toward the remittance processing station 2. As previously indicated, the belts 118 associated with the arm 115 are preferably sized and configured to engage only bottom portions of the documents 42 being transported, leaving upper portions of the documents 42 exposed to the operator (leaving the financial data shown on the documents exposed as well). The documents 42 will then be delivered along the arm 115, reaching the output rollers 120 just prior to introduction into the remittance processing station 2. Subsequent handling of the documents 42 will depend upon the operating mode selected for the overall system.

For example, in a "presentation" mode, the documents 42 may be delivered to the end of the arm 115, and stopped for presentation to the operator. The operator can then read the document 42 and/or remove the document 42 from the arm 115 in order to read the information which is present on the document. Following appropriate data entry, the document 42 can then be manually introduced into the drop slot associated with the remittance processing station 2.

In a "semi-automatic" mode, the arm 115 may be moved adjacent to the remittance processing station 2 so that the document 42 can be delivered from the arm 115 to the input for the remittance processing station 2. However, each document (invoice/check) is stopped at the end of the arm 115 so that the operator may check the orientation for that document and, if necessary, reorient the document by removing the document from the arm 115 and introducing the document into the remittance processing station 2 in a correct orientation. Correctly oriented documents could be automatically discharged from the arm 115, for direct introduction into the remittance processing station 2.

In a "fully automatic" mode, the operator need not interface with the documents 42 traversing the arm 115, but rather is permitted to read the information on each document 42 as it traverses the arm 115 (since the upper portions of the document remain exposed). The arm 115 is of a sufficient length so that for an appropriate transport rate, adequate time is available for the entry of desired information prior to delivery of the document 42 from the arm 115 to the remittance processing station 2, or to grasp a document to be removed from the arm 115 (for inspection or inversion) for return prior to delivery of the document 42 from the arm 115 to the remittance processing station 2. Indeed, resulting from operations of the buffer mechanism 135, an invoice of a document pair will ordinarily be delivered to the remittance processing station 2 just prior to the delivery of the corresponding check, allowing the operator to handle the check, as desired, while the corresponding invoice is being processed by the remittance processing station 2.

Figure 18:
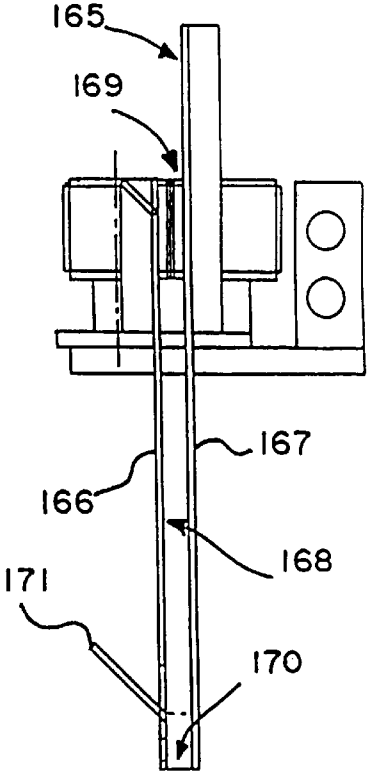
FIG. 18 is an end elevational view of the drop chute of FIG. 17.
Figure 17:
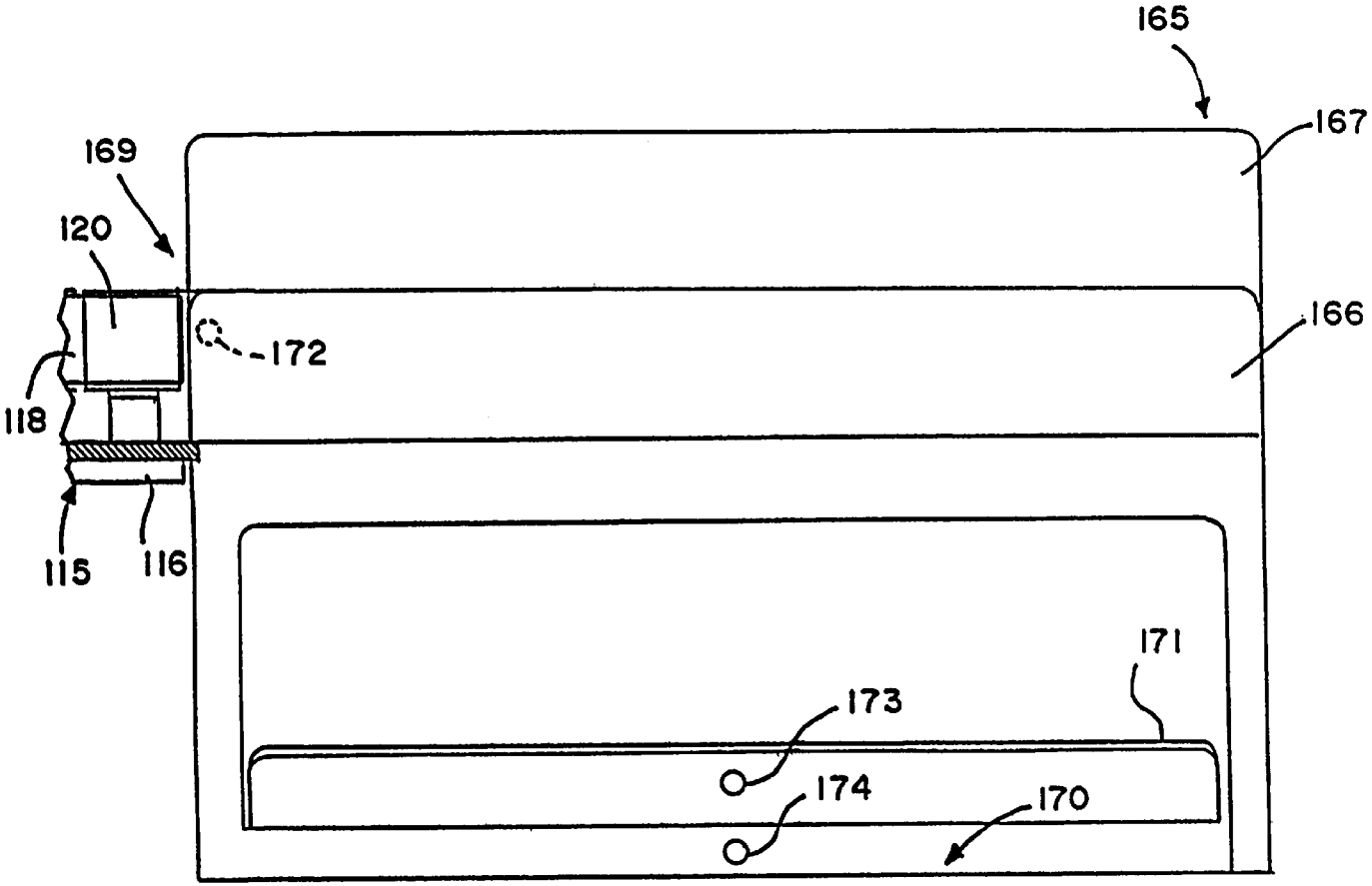
FIG. 17 is a side elevational view of a drop chute for use in conjunction with the delivery arm of FIG. 14.

To assist in implementing the above-described operating modes, the end of the arm 115 may be provided with its own drop chute 165 for communicating with the drop slot of the remittance processing station 2, as illustrated in FIGS. 17 and 18. The drop chute 165 includes a front face 166 and a rear face 167 which are separated by an open space 168 for receiving documents from the arm 115, at 169, and for delivering documents to the remittance processing station 2, at 170. As a result, documents present at the end of the arm 115 may be discharged from between the output rollers 120, entering the open space 168 developed between the opposing faces 166, 167 and falling from the drop chute 165, at 170. Documents present at the end of the arm 115 may also be removed from between the output rollers 120, for manual handling, and then returned to the open space 168 developed between the opposing faces 166, 167 by inserting such documents into an angled entry slot 171 which is provided in the front face 166 of the drop chute 165. In either case, documents are effectively delivered from the drop chute 165 to the drop slot of the remittance processing station 2, for further processing as appropriate. The front face 166 is preferably formed of a transparent material to facilitate viewing of the documents which are to be processed.

The drop chute 165 can additionally and advantageously incorporate sensors for monitoring the passage of documents through it. For example, a sensor 172 may be positioned at the end of the arm 115 in order to monitor the arrival and departure of documents at the output rollers 120. A sensor 173 may be positioned near the bottom 170 of the drop chute 165 in order to monitor the passage of documents to the remittance processing station 2. A sensor 174 may be provided at the entry slot 171 in order to monitor the receipt of documents through this interface. Any of a variety of sensor types may be used to implement these functions, although optical sensing devices are generally preferred in order to minimize interference with the documents as they pass through the drop chute 165.

To be noted is that if multiple remittance processing stations 2, 2', 2" are employed, these operating modes may be mixed and matched, as desired, responsive to sorting operations associated with the apparatus 1. In this fashion, work flow may be matched to different remittance processing devices which are configured to best respond to documents which have been fed in the presentation, semi-automatic and fully-automatic modes which are achievable in accordance with the present invention. Also to be noted is that the apparatus 1 is capable of providing a "manual" mode in which the apparatus 1 primarily serves as a document stacker, so that the operator can withdraw stacks of sorted documents from the apparatus 1 for data entry at the remittance processing station 2 (in otherwise conventional fashion). FIG. 13 illustrates an apparatus 1 which is advantageously employed in a manual mode of operation.

The foregoing describes numerous components for receiving envelopes in bulk form, for then extracting documents from the envelopes, and for then delivering the extracted documents to a remittance processing device, both continuously and automatically. However, it should be understood that these components, and the preferred embodiments which have been described, can be freely varied to suit a particular application.

Some of these variations have already been discussed. For example, the thickness measuring device 6, the metal detecting device 7, and the orientation determining device 10 may be employed in accordance with the present invention, or deactivated, or even deleted, as desired. This also applies to the sorting device 12 which follows these components, as well as the stacking units 81, 82, 83 of the distribution station 80. Other types of sorting devices may also be employed, if desired. For example, a bar code reader may be placed at appropriate locations in order to read coded labeling (e.g., private labeling or conventional Post Office bar coding) and sort envelopes and/or documents responsive to the coding which they include.

Yet another variation which has previously been discussed involves the use of pre-slit envelopes (which would then allow the cutting station 20 to be omitted), or the use of other types of automated edge-severing equipment to slit envelopes prior to their introduction into the extraction station 25. Alternatively,.envelopes could be received from a high speed sorting device, such as the Model 30 high speed sorting device manufactured by Opex Corporation of Moorestown, N.J., if desired. In such case, duplicative modules (e.g., the thickness measuring device 6, the metal detecting device 7, the orientation determining device 10 and the sorting device 12) could be deleted from the apparatus 1 of the present invention. The configuration for the extraction station 25 may also be varied, if desired. Yet another variation which has previously been discussed is to change the number of stacking units 81, 82, 83, or the number of remittance processing stations 2 which are employed, or to delete these structures from the overall apparatus 1, as desired.

Figure 19:
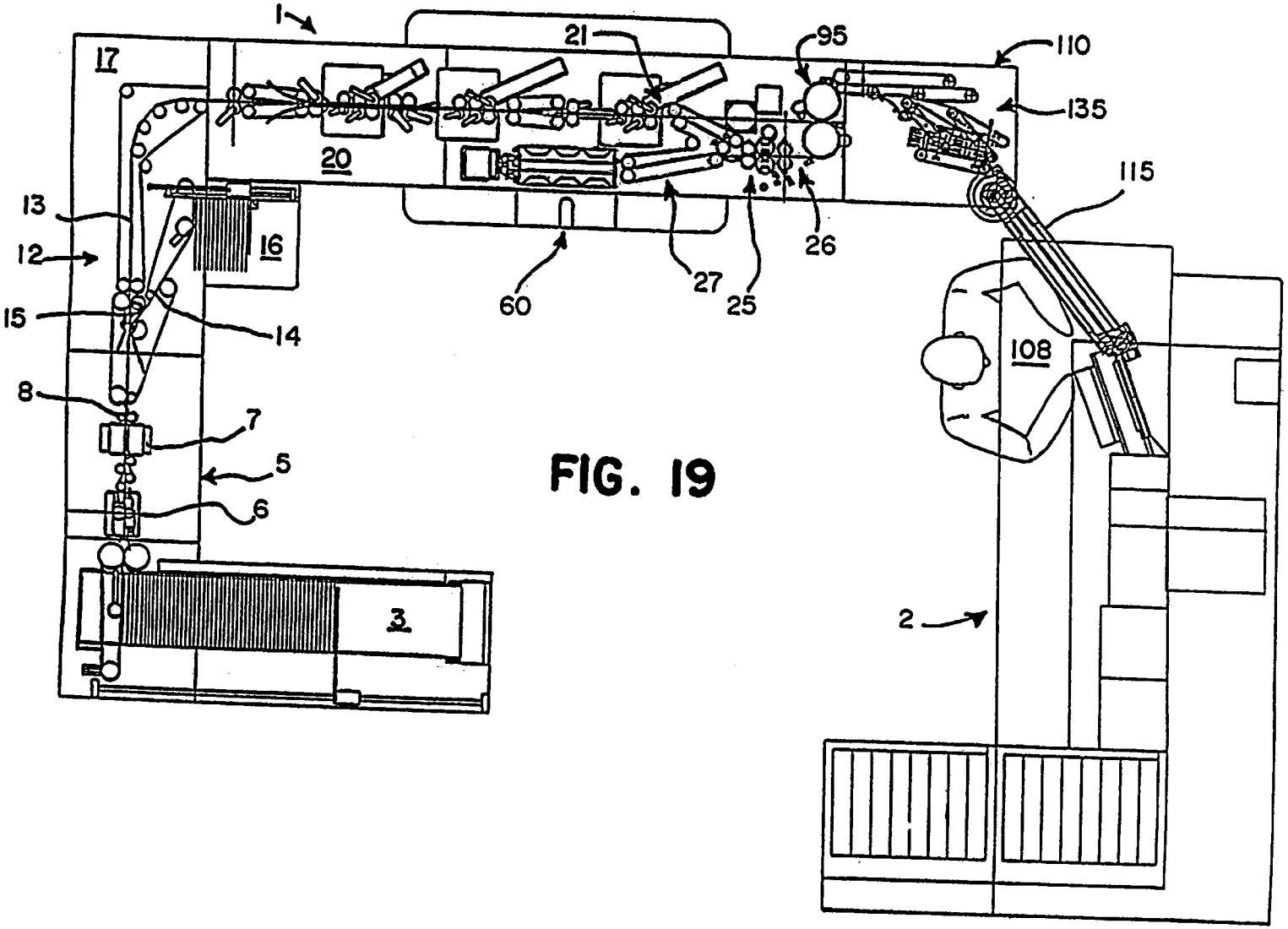
FIGS. 19 and 20 are schematic, plan views of yet other alternative embodiment apparatus produced in accordance with the present invention.

For example, by deleting the stacking units 81, 82, 83, documents could be discharged directly from the extraction station 25 (including a justification device 95, if desired) and to the document delivery system 110, for subsequent remittance processing irrespective of their orientation. In such case, documents would be delivered to the operator of the remittance processing station 2 in random orientation, allowing the operator to access documents as they progress along the arm 115 toward the remittance processing station 2 for manual reorientation and data entry prior to packaging for deposit (as is presently often done). This would also permit removal of the orientation determining device 10, in addition to the stacking units 81, 82, 83 (or any reorienting equipment which might otherwise be employed as noted below), developing the simplified apparatus which is shown in FIG. 19 of the drawings.

Alternatively, the orientation determining device 10 could be retained, and used to provide signals for distributing documents (according to their orientation) to different remittance processing devices configured to accommodate documents of a particular configuration (e.g., since on the order of 70% of the document pairs extracted from "windowed" envelopes are correctly oriented, these items could be forwarded to a first remittance processing device configured to receive such documents, while remaining (misoriented) pairs of documents could be forwarded on to a second remittance processing device configured to receive them, or even to three different remittance processing devices configured to receive documents in the remaining three orientations which are possible). Thus, instead of sorting documents according to their orientation, for separate stacking, the documents can instead be routed to a desired remittance processing station 2 which is configured to receive them (enhancing productivity by taking advantage of the special features of the remittance processing device, and uniformity in the presentation of documents to the operator).

Alternatively, by providing the apparatus 1 with a bar code reader as previously suggested, documents may be similarly delivered to different remittance processing devices responsive to coded information on the documents or the envelopes which contained them. In this fashion, the documents could be sorted (and routed) according to private-label coded information, or Post Office zip coding, allowing jobs to be grouped and routed to different remittance processing devices (which are preferably then configured to receive them).

Figure 20:
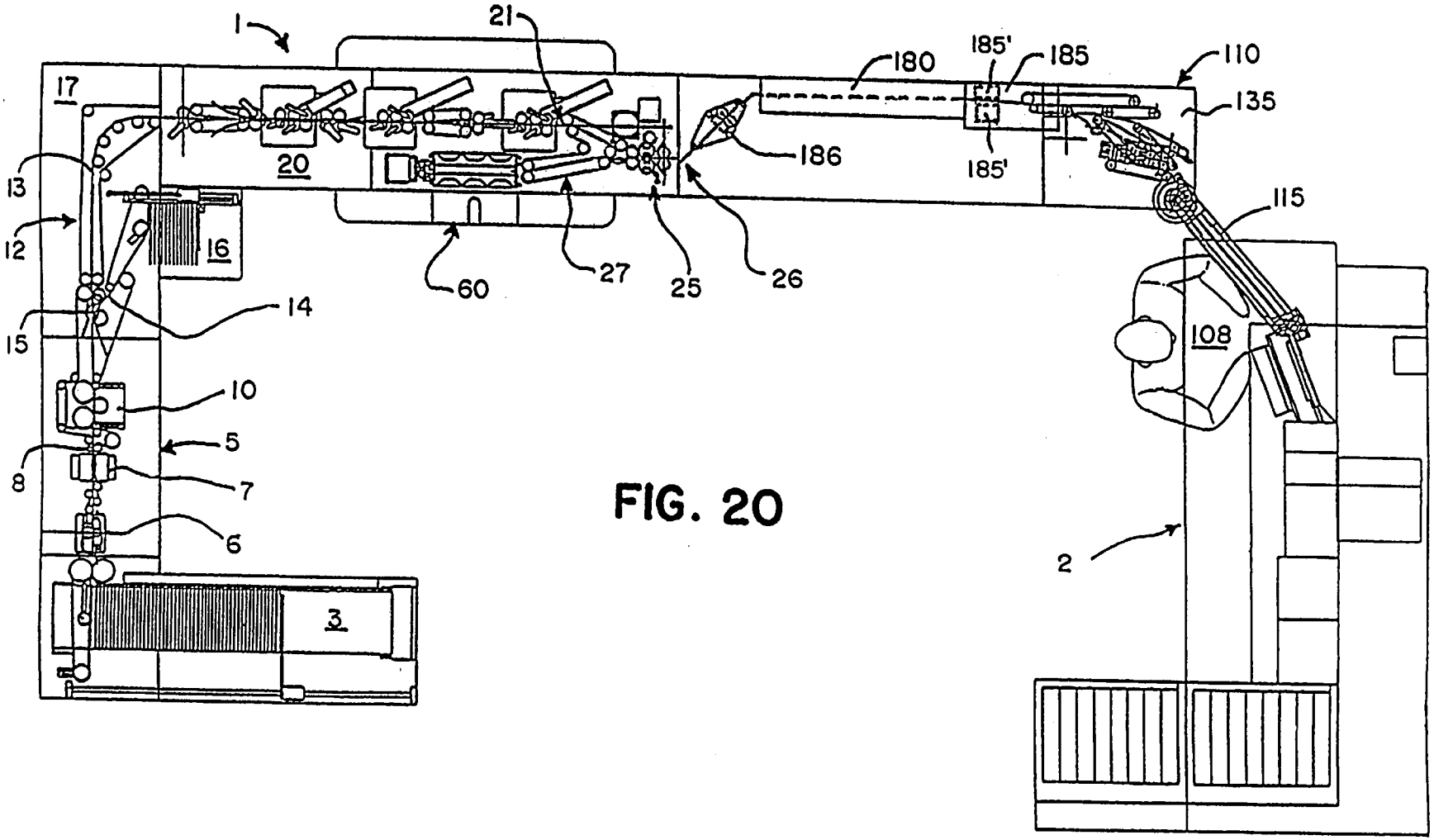

Another variation which may be accomplished in accordance with the present invention is to replace the stacking units 81, 82, 83 of the distribution station 80 with means 180 for orienting documents discharged from the extraction station 25 responsive to signals initiated by the orientation determining device 10. Such an embodiment is illustrated in FIG. 20 of the drawings. This could include the inversion of documents from top to bottom, and the inversion of documents from end to end, making use of means which are disclosed in U.S. Pat. No. 4,863,037, with reference to the reversal and twisting stations which are described. Indeed, in such case, it would even be possible to interconnect the output of the document orienting portions of the apparatus disclosed in U.S. Pat. No. 4,863,037 with one or more remittance processing stations 2 by means of one or more document delivery systems 110, as previously described. Documents discharged by the extraction apparatus would then be uniformly oriented and ready for remittance processing.

Another variation which may be accomplished in accordance with the present invention is to provide the apparatus 1 with additional devices for interfacing with the remittance processing station 2, preferably just prior to the delivery of documents to the document distribution system 110. For example, the apparatus 1 could incorporate a module 185 for reading documents extracted from the envelopes which have been processed (either with or without, or before or after any sorting operations which are accomplished). This could include a bar code reader as previously described, for subsequent routing purposes. However, this could advantageously include devices for reading numerical data shown on the invoices and checks, to ready such information for subsequent operations of the remittance processing station 2. One use for this would be to identify paired documents (invoice and check) which correspond in amount (so-called "full pays"), for delivery to a remittance processing station 2 which is configured to operate in its "power encoding" mode, which automatically feeds invoices and encodes checks with a dollar amount (in automated fashion and on an expedited basis). Devices for obtaining such information from checks and invoices are known and currently available, including neural networks for reading the dollar amount shown on a check and OCR (optical character recognition) networks for reading the dollar amount shown on the invoice.

Alternatively, the module 185 could incorporate a video camera or cameras 185' for acquiring images from either or both sides of the documents which are being processed, to enable an operator (or even the apparatus 1) to make decisions regarding the disposition of such documents according to information found on them. The video monitor for the operator could be stationed locally, near the apparatus 1, or remotely, as desired. The acquired images could be displayed separately, or overlayed, according to need. The operator (or the apparatus 1) could additionally be provided with a routing switch for distributing documents according to the data revealed by the acquired video images in order to regulate the distribution of documents to the one or more remittance processing devices which are associated with the apparatus 1. The video cameras 185' could be replaced with a viewing window, if desired, simplifying the overall system.

To be noted is that in order to employ the foregoing techniques, the documents being discharged from the extraction station 25 must first be separated, at 186 (paired, parallel documents separated for serial distribution), so that the documents may be individually accessed.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. A method for presenting documents to a plurality of remittance processing devices, comprising the steps of:

separating received documents for serial presentation to the remittance processing devices; and conveying the documents alone a document transport in series to a delivery arm of one of the remittance processing device for introduction to the remittance processing device, thereby permitting remittance processing of the documents.

2. An apparatus for presenting documents to a plurality of remittance processing devices, each remittance processing device having a delivery arm comprising:

means for separating receiving documents for serial presentation to the remittance processing device; and means for conveying the documents in series to the delivery arm of one of the remittance processing devices for introduction to the remittance processing device, thereby permitting remittance processing of the documents.

* * * * *

UNITED STATES PATENT AND TRADEMARK OFFICE
CERTIFICATE OF CORRECTION

PATENT NO. : 5,842,693

DATED : December 1, 1998

INVENTOR(S) : Albert F. Stevens, Mark A. Stevens, Robert R. DeWitt, William R. Lile, Michael E. York, Jeffrey L. Chodack and Roy E. Patterson

It is certified that error appears in the above-identified patent and that said Letters Patent is hereby corrected as shown below:

Column 24

Line 11: change "alone" should be --along--

Signed and Sealed this

Thirtieth Day of March, 1999

*Attest:*

*Attesting Officer*

Q. TODD DICKINSON

*Acting Commissioner of Patents and Trademarks*